US006928342B2

(12) United States Patent
Horst

(10) Patent No.: US 6,928,342 B2
(45) Date of Patent: Aug. 9, 2005

(54) METHOD AND APPARATUS IMPLEMENTING A COMMUNICATION PROTOCOL FOR USE IN A CONTROL SYSTEM

(75) Inventor: Folkert D. Horst, Pierrefonds (CA)

(73) Assignee: Beltpack Corporation, Montreal (CA)

( * ) Notice: Subject to any disclaimer, the term of this patent is extended or adjusted under 35 U.S.C. 154(b) by 32 days.

(21) Appl. No.: 10/326,795

(22) Filed: Dec. 20, 2002

(65) Prior Publication Data

US 2004/0088086 A1 May 6, 2004

(30) Foreign Application Priority Data

Oct. 31, 2002 (CA) ..... 2410697

(51) Int. Cl.[7] ..... B61L 3/00

(52) U.S. Cl. ..... 701/19; 701/2; 701/20; 246/3; 246/4; 246/5; 246/187 A; 246/167 R

(58) Field of Search ..... 701/2, 19, 20; 246/3, 4, 5, 167 R, 187 A

(56) References Cited

U.S. PATENT DOCUMENTS 3,696,758 A * 10/1972 Godinez, Jr. ..... 105/61
3,959,586 A * 5/1976 Blomenkamp ..... 375/238
4,087,066 A 5/1978 Bahker et al.
4,245,347 A 1/1981 Hutton et al.
4,711,418 A 12/1987 Aver, Jr. et al.
4,720,067 A 1/1988 Jaeger
5,420,883 A * 5/1995 Swensen et al. ..... 375/138
5,511,749 A 4/1996 Horst et al.
5,570,284 A * 10/1996 Roselli et al. ..... 701/2
5,685,507 A 11/1997 Horst et al.
5,884,146 A * 3/1999 Simmons ..... 455/68
6,175,784 B1 * 1/2001 Jicha et al. ..... 701/19
6,314,345 B1 * 11/2001 Coombes ..... 701/19
6,449,536 B1 9/2002 Brousseau et al.
6,456,674 B1 9/2002 Horst et al.

FOREIGN PATENT DOCUMENTS

CA 2248526 A1 * 3/2000 ..... H04B/1/04

* cited by examiner

*Primary Examiner*—Michael J. Zanelli
*Assistant Examiner*—Eric M. Gibson
(74) *Attorney, Agent, or Firm*—Merchant & Gould P.C.

(57) ABSTRACT

A remote control unit for controlling a locomotive by transmitting signals to a remote receiver mounted onboard the locomotive is provided. The remote control unit includes an input for receiving a signal indicative of a command selected from a set of available commands. A signal transmitting unit transmits a signal indicative of the selected command repetitively to create a succession of signal transmission events. In a first example, each signal transmission event is spaced in time from a previous signal transmission event by a certain time interval having a duration conditioned at least in part on the basis of the selected command. In a second example, each signal transmission event includes a message portion and a header portion and the message portion of the signal has a length conditioned at least in part on the basis of the selected command. In a third example, each signal transmission event is characterized by a signal level conditioned at least in part on the basis of the selected command. The signal transmitting unit includes an RF modulator adapted for modulating data indicative of the selected command to generate a succession of modulated signals, each modulated signal corresponding to a respective signal transmission event in the succession of signal transmission events.

87 Claims, 10 Drawing Sheets

METHOD AND APPARATUS IMPLEMENTING A COMMUNICATION PROTOCOL FOR USE IN A CONTROL SYSTEM

FIELD OF THE INVENTION

This invention relates to the field of communication and control systems. It is particularly applicable to methods and apparatus for transmitting data and control information over transmission channels with multiple users.

BACKGROUND OF THE INVENTION

Microprocessors are commonly used in control systems to regulate a wide variety of systems from the simple hand held calculator to large mechanical systems such as valves and vehicles. In a specific example, microprocessors are used to control vehicles such as locomotives in order to perform functions including braking, traction control and acceleration. Radio frequency transmitter-receiver pairs are of particular interest for remotely controlling such vehicles.

In a typical remote locomotive control system, the operator communicates with a microprocessor-based controller onboard the locomotive using a remote control device capable of emitting control signals. The operator enters requests into the remote control device via any suitable input such as a keyboard, touch screen or any other suitable system. Typical requests may include brake commands, throttle commands, speed commands or any function that a locomotive may be capable of performing. The remote control device encodes the request into a form suitable for transmission over a pre-determined frequency link. Usually, a tag is added on to the request to indicate the locomotive for which the request is destined as well as an identifier defining the remote control device from which the request originates. The complete request is then modulated at the pre-determined radio frequency and transmitted as a RF signal. Frequencies other than RF can also be used for this purpose.

A receiver aboard the locomotive is equipped with a decoder module that receives and demodulates the RF signal originating from the remote control unit. The signal is then decoded and the validity of the request is verified. Typically, verifying the validity of a request involves performing a sequence of operations to verify if the remote control unit from which the request originates is permitted to issue requests to the particular locomotive as well as verifying if the signal received is intact. Generally, a computer readable medium in the receiver stores an identifier indicative of the remote control unit assigned to the locomotive. The identifier is compared to the tag contained in the received demodulated request. Another operation in the verification of the signal involves verifying if the signal is intact by using a check sum or other suitable error detection or correction algorithm. Verifying that a message is intact is well known in the art of signal processing. If the signal is valid it is then processed further so the command contained in the request can be implemented.

Locomotive control systems of the type described above operate in railroad environments concurrently with many other similar locomotive control devices including remote control units and receivers. Commonly, many remote control modules operate on the same radio frequency channel or on overlapping radio frequency channels often resulting in interference between the various signals. Signals transmitted in overlapping frequency channels cannot be resolved into their respective signals by the receiver module solely on the basis of frequency filtering. The interference of the signals typically causes commands to be lost.

Commonly, existing communication systems make use of a remote control unit designed to repetitively transmit a signal of a fixed length a fixed number of times during a given time segment. In a first example of such a system, a remote control unit sends a command repetitively at a given rate and each remote control unit is assigned a unique repetition rate. The unique repetition rates are selected such that the likelihood of messages interfering with one another is reduced. A variant of this method is described in detail in U.S. Pat. No. 4,245,347 by Hutton et al. whose content is hereby incorporated by reference. In second example, a remote control unit sends a command repetitively to create a succession of signal transmission events where each signal transmission event is spaced in time from a previous signal transmission event by a certain time interval characterized by a certain duration. In such an alternate solution, the durations of time between transmission events are non-uniform. For example the durations of time can be randomly determined or determined according to a pre-determined sequence of time durations. A variant on this method is described in detail in U.S. Pat. No. 6,456,674 by Horst et al. whose content is hereby incorporated by reference.

A deficiency of the systems of the type described above is that a significant amount of valuable bandwidth is occupied by commands being sent repetitively which results into a constraint on the number of locomotive control systems that may adequately operate on a given radio frequency channel.

Consequently there exists a need in the industry to provide an improved system and method for transmitting commands in a control system that alleviates at least in part the deficiencies of prior art systems and methods.

SUMMARY OF THE INVENTION

In accordance with a broad aspect, the invention provides a method for remotely controlling a locomotive. The method includes enabling an operator to select a command among a set of available commands. A signal indicative of the selected command is transmitted repetitively to a receiver onboard the locomotive to create a succession of signal transmission events. Each signal transmission event is spaced in time from a previous signal transmission event by a certain time interval characterized by a duration. The duration of the certain time interval is conditioned at least in part on the basis of the selected command.

In a specific example of implementation, each command in the set of available commands is associated to a respective level of importance and the duration of the certain time interval is conditioned at least in part on the basis of the level of importance of selected command. In a non-limiting example, when the level of importance of a first command is lower than the level of importance of a second command, the duration of the time interval between transmission events for the first command is set to be longer than the duration of the time interval between transmission events for the second command. For example, an parked command instructing a locomotive to remain parked or stationary can be associated to a lower level of importance that an emergency brake command instructing a locomotive to apply the emergency brakes. Therefore, the duration of the time intervals for the transmission of the parked command may be set to be longer than the duration of the time intervals for the transmission of the emergency brake command. The invention allows commands that are critical to the safety of the locomotive to be transmitted at a higher transmission rate (shorter duration between transmission events) while commands that are not as critical are transmitted at a lower transmission rate (longer duration between transmission events).

Advantageously, by varying the duration of the time interval on the basis of the level of importance of the command, a certain control of the bandwidth utilization can be achieved while maintaining a high level of safety. For example, when a train remains parked, the repetition rate of the signal may be set to be very low without consequence to the safety of the locomotive. Consequently, the above-described method allows accommodating an increased number of remote control unit/receiver pairs on a same carrier frequency by providing an increased level of control on bandwidth utilization.

Advantageously, by increasing the duration between signal transmission events for commands with a relatively low level of importance and therefore effecting fewer transmissions for a given time segment, more efficient power consumption for the remote control unit can be achieved. This is particularly advantageous where the remote control unit is battery operated.

In a specific example of implementation, a duration data element is derived at least in part on the basis of the selected command. The time interval between a signal transmission event and a previous signal transmission event is varied on the basis of the duration data element to alter a rate of occurrence of the transmission events on the basis of the selected command.

In a first non-limiting implementation, a data structure is provided associating a command to a corresponding duration data element. The selected command is processed to extract from the data structure a certain duration data element corresponding to the selected command. The time interval between a signal transmission event and a previous signal transmission event is varied on the basis of the duration data element to alter a rate of occurrence of the transmission events on the basis of the selected command.

In a second non-limiting implementation, a data structure including a plurality of entries is provided. Each entry in the data structure associates one or more commands to a set of corresponding duration data elements. The selected command is processed to locate a certain entry associating the selected command and to a certain set of corresponding duration data elements and at least one duration data element is selected from the certain set of corresponding duration data elements. The time interval between a signal transmission event and a previous signal transmission event is varied on the basis of the duration data element to alter a rate of occurrence of the transmission events on the basis of the selected command.

Advantageously, by providing a set of corresponding duration data elements associated to a given command, the time interval between a signal transmission event and a previous signal transmission event can be modified for a same command.

In accordance with another specific example of implementation, during a first time segment each signal transmission event is spaced in time from a previous signal transmission event by a certain time interval characterized by a first duration. During a second time segment subsequent to the first time segment, each signal transmission event is spaced in time from a previous signal transmission event by a certain time interval characterized by a second duration different from the first duration. At least one of the first duration and second duration is conditioned at least in part on the basis of the selected command.

In accordance with another broad aspect, the invention provides an apparatus for implementing the above-described method. The apparatus includes a signal transmitting unit for transmitting a signal indicative of the selected command repetitively to a receiver onboard the locomotive to create a succession of signal transmission events. Each signal transmission event is spaced in time from a previous signal transmission event by a certain time interval characterized by a duration. The duration of the certain time interval is conditioned at least in part on the basis of the selected command. The signal transmitting unit includes an RF modulator adapted for modulating data indicative of the selected command to generate a succession of modulated signals. Each modulated signal generated by the RF modulator corresponds to a respective signal transmission event in the succession of signal transmission events.

In accordance with another broad aspect, the invention provides a remote control unit for use in controlling a locomotive and implementing the above-described method. The remote control unit may be a portable device or may be mounted on a platform. In a first implementation, the remote control device includes a manually operable command interface for enabling an operator to select a command among a set of available commands. The command interface may be of any suitable configuration allowing the user to manually provide commands. In a non-limiting example of implementation, the manually operable command interface may include a pointing device, keyboard, levers, switches and knobs amongst others. In a second implementation, the command interface may be of a configuration allowing the user to input commands through a voice input by formulating a command in the form of a spoken utterance. In such an implementation, the remote control unit includes a speech recognition engine that attempts to match the spoken utterance to a vocabulary item indicative of a command in a speech recognition dictionary.

In accordance with yet another broad aspect, the invention provides a computer readable medium including a program element suitable for execution by a CPU for causing a command to be repetitively transmitted to a receiver onboard a locomotive in accordance with the above described method.

In accordance with another broad aspect, the invention provides a method for remotely controlling a locomotive. The method includes enabling an operator to select a command among a set of available commands. A signal indicative of the selected command is transmitted repetitively to a receiver onboard the locomotive to create a succession of signal transmission events. Each signal transmission event includes a message portion and a header portion where the message portion has a length conditioned at least in part on the basis of the selected command.

In a specific example of implementation, for at least one command in the set of available commands, during a first time segment, the message portion of each signal transmission event is of a first length. During a second time segment, the message portion of each signal transmission event is of a second length, the second length being different from the first length. Either one of the first length and the second length is conditioned at least in part on the basis of the selected command.

For example, when a train command is for instructing a locomotive to remain parked, during a first time segment until a predetermined amount of time, the length of the message portion of the signal can be set to a first length. When the period of time during which the parked command is being transmitted exceeds a predetermined amount of time, the length of the message portion of the signal can be set to a second length. Advantageously, the second length may be set to be short than the first length such as to reduce the bandwidth use without consequence to the safety of the locomotive. In a non-limiting example, the message portion of the second length may indicate that the previous command is to be repeated instead of transmitting the complete command.

In a specific example of implementation, each command in the set of available commands is associated to a respective level of importance and the duration of the certain time interval is conditioned at least in part on the basis of the level of importance of selected command.

Advantageously, by providing variable length messages where the length of the message is dependent upon the type of command being transmitted from the remote control unit, an improved use of bandwidth can be achieved. In a non-limiting example, when the criticality of the message is of a relatively low importance, the length of the message is reduced. For instance, when a train remains parked for a period of time exceeding a predetermined amount of time, the length of the message may be reduced without any consequence to the safety of the locomotive.

In accordance with another broad aspect, the invention provides an apparatus for implementing the above-described method. The apparatus includes a signal transmitting unit for transmitting a signal indicative of the selected command repetitively to a receiver onboard the locomotive to create a succession of signal transmission events. The signal transmitting unit includes an RF modulator adapted for modulating data indicative of the selected command to generate a succession of modulated signals. Each modulated signal generated by the RF modulator corresponds to a respective signal transmission event in the succession of signal transmission events.

In accordance with another broad aspect, the invention provides a remote control unit for use in controlling a locomotive and implementing the above-described method.

In accordance with yet another broad aspect, the invention provides a computer readable medium including a program element suitable for execution by a CPU for causing a command to be repetitively transmitted to a receiver onboard a locomotive in accordance with the above described method.

In accordance with another broad aspect, the invention provides a remote control unit for controlling a locomotive by transmitting signals to a remote receiver mounted onboard the locomotive. The remote control unit includes a command interface allowing an operator to select a command among a set of available commands. The remote control unit also includes a signal transmitting unit operative to transmit a signal indicative of the selected command repetitively to create a succession of signal transmission events where each signal transmission event including a message portion and a header portion. The signal transmitting unit includes a message length control module and an output module. The message length control module has an input to receive at least one parameter where the at least one parameter is derived from the selected command. The message length control module derives at least one message length data element at least in part on the basis of the at least one parameter and releases the at least one message length data element at an output. The output module includes an RF modulator adapted to output repeatedly a modulated signal indicative of the selected command to create a succession of modulated signals where each modulated signal corresponds to a respective signal transmission event in the succession of signal transmission events. The message portion of each succession of signal transmission event has a length conditioned on the basis of the at least one message length data element.

In accordance with yet another broad aspect, the invention provides method for controlling a locomotive. The method includes enabling an operator to select a command among a set of available commands. A signal indicative of the selected command is transmitted repetitively to a receiver onboard the locomotive to create a succession of signal transmission events. The succession of signal transmission events being such that during a first time segment, each signal transmission event is spaced in time from a previous signal transmission event by a certain time interval characterized by a first duration. During a second time segment, each signal transmission event is spaced in time from a previous signal transmission event by a certain time interval characterized by a second duration different from the first duration.

In a non-limiting implementation, at least one of the first duration and the second duration is conditioned at least in part on the basis of the selected command.

In accordance with another broad aspect, the invention provides an apparatus for implementing the above-described method. The apparatus includes a signal transmitting unit for transmitting a signal indicative of the selected command repetitively to a receiver onboard the locomotive to create a succession of signal transmission events. The signal transmitting unit includes an RF modulator adapted for modulating data indicative of the selected command to generate a succession of modulated signals. Each modulated signal generated by the RF modulator corresponds to a respective signal transmission event in the succession of signal transmission events.

In accordance with another broad aspect, the invention provides a remote control unit for use in controlling a locomotive and implementing the above-described method. In accordance with yet another broad aspect, the invention provides a computer readable medium including a program element suitable for execution by a CPU for causing a command to be repetitively transmitted to a receiver onboard a locomotive in accordance with the above described method.

In accordance with another broad aspect, the invention provides a remote control unit for controlling a locomotive by transmitting signals to a remote receiver mounted onboard the locomotive. The remote control unit includes a command interface allowing an operator to select a command among a set of available commands. The remote control unit also includes a signal transmitting unit operative to transmit a signal indicative of the selected command repetitively to create a succession of signal transmission events. The signal transmission unit includes a time interval duration control module and an output unit. The time interval duration control module has an input to receive at least one parameter where the at least one parameter is derived from the selected command. The time interval duration control module derives at least one duration data element at least in part on the basis of the at least one parameter and for releases the at least one duration data element at an output. The output module includes an RF modulator adapted to output repeatedly a modulated signal indicative of the selected command to create a succession of modulated signals. Each modulated signal corresponds to a respective signal transmission event in the succession of signal transmission events, and each signal transmission event being spaced in time from a previous signal transmission event by a certain time interval characterized by a duration. The duration of the certain time interval is determined on the basis of the at least one duration data element.

In accordance with another broad aspect, the invention provides a method for remotely controlling a locomotive. The method includes enabling an operator to select a command among a set of available commands. A signal indicative of the selected command is transmitted repetitively to a receiver onboard the locomotive to create a succession of signal transmission events. Each signal transmission event includes a message portion and a header portion. For at least one command in the set of available commands, during a first time segment, the message portion of each signal transmission event is of a first length. During a second time segment, the message portion of each signal transmission event is of a second length, where the second length being different from the first length.

In a non-limiting implementation, at least one of the first length and the second length is conditioned at least in part on the basis of the selected command.

In accordance with another broad aspect, the invention provides an apparatus for implementing the above-described method. The apparatus includes a signal transmitting unit for transmitting a signal indicative of the selected command repetitively to a receiver onboard the locomotive to create a succession of signal transmission events. The signal transmitting unit includes an RF modulator adapted for modulating data indicative of the selected command to generate a succession of modulated signals. Each modulated signal generated by the RF modulator corresponds to a respective signal transmission event in the succession of signal transmission events.

In accordance with another broad aspect, the invention provides a remote control unit for use in controlling a locomotive and implementing the above-described method.

In accordance with yet another broad aspect, the invention provides a computer readable medium including a program element suitable for execution by a CPU for causing a command to be repetitively transmitted to a receiver onboard a locomotive in accordance with the above described method.

In accordance with a broad aspect, the invention provides a method for remotely controlling a locomotive. The method includes enabling an operator to select a command among a set of available commands. A signal indicative of the selected command is transmitted repetitively to a receiver onboard the locomotive to create a succession of signal transmission events. Each signal transmission event has a signal power level conditioned at least in part on the basis of the selected command.

In a specific implementation, a power level data element is derived at least in part on the basis of the selected command and used for varying the power level of a signal transmission event on the basis of the selected command.

In a specific implementation, commands in the set of available commands are associated to respective levels of importance, the power level data elements being conditioned at least in part on the basis of the level of importance of selected command.

Advantageously, by providing variable power levels where the power levels are dependent upon the type of commands being transmitted from the remote control unit, more efficient power consumption for the remote control unit can be achieved. This is particularly advantageous where the remote control unit is battery operated. In a non-limiting example, when the criticality of the message is of a relatively low importance, the power level is reduced. For instance, when a train remains parked for a period of time exceeding a predetermined amount of time, the power level of the signal may be reduced without any consequence to the safety of the locomotive.

In a specific example of implementation, a power level data element is derived at least in part on the basis of the selected command. The power level data element of a signal transmission event is varied on the basis of the power level data element to alter a power level on the basis of the selected command.

In a first non-limiting implementation, a data structure is provided associating a command to a corresponding power level data element. The selected command is processed to extract from the data structure a certain power level data element corresponding to the selected command. The power level of a signal transmission event is varied on the basis of the power level data element to alter the power level element of the transmission events on the basis of the selected command.

In a second non-limiting implementation, a data structure including a plurality of entries is provided. Each entry in the data structure associates one or more commands to a set of corresponding power level data elements. The selected command is processed to locate a certain entry associating the selected command and to a certain set of corresponding power level data elements and at least one power level data element is selected from the certain set of corresponding power level data elements. The power level of a signal transmission event is varied on the basis of the power level data element to alter the power level element of the transmission events on the basis of the selected command.

Advantageously, by providing a set of corresponding power level data elements associated to a given command, the time interval between a signal transmission event and a previous signal transmission event can be modified for a same command.

In accordance with another specific example of implementation, during a first time segment each signal transmission event is transmitted at a first power level. During a second time segment subsequent to the first time segment, each signal transmission event is transmitted at a second power level different from the first power level. At least one of the first power level and second power level is conditioned at least in part on the basis of the selected command.

In accordance with another broad aspect, the invention provides an apparatus for implementing the above-described method. The apparatus includes a signal transmitting unit for transmitting a signal indicative of the selected command repetitively to a receiver onboard the locomotive to create a succession of signal transmission events. The signal transmitting unit includes an RF modulator adapted for modulating data indicative of the selected command to generate a succession of modulated signals. Each modulated signal generated by the RF modulator corresponds to a respective signal transmission event in the succession of signal transmission events.

In accordance with another broad aspect, the invention provides a remote control unit for use in controlling a locomotive and implementing the above-described method.

In accordance with yet another broad aspect, the invention provides a computer readable medium including a program element suitable for execution by a CPU for causing a command to be repetitively transmitted to a receiver onboard a locomotive in accordance with the above described method.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

A detailed description of examples of implementation of the present invention is provided herein below with reference to the following drawings, in which.

Figure 1:
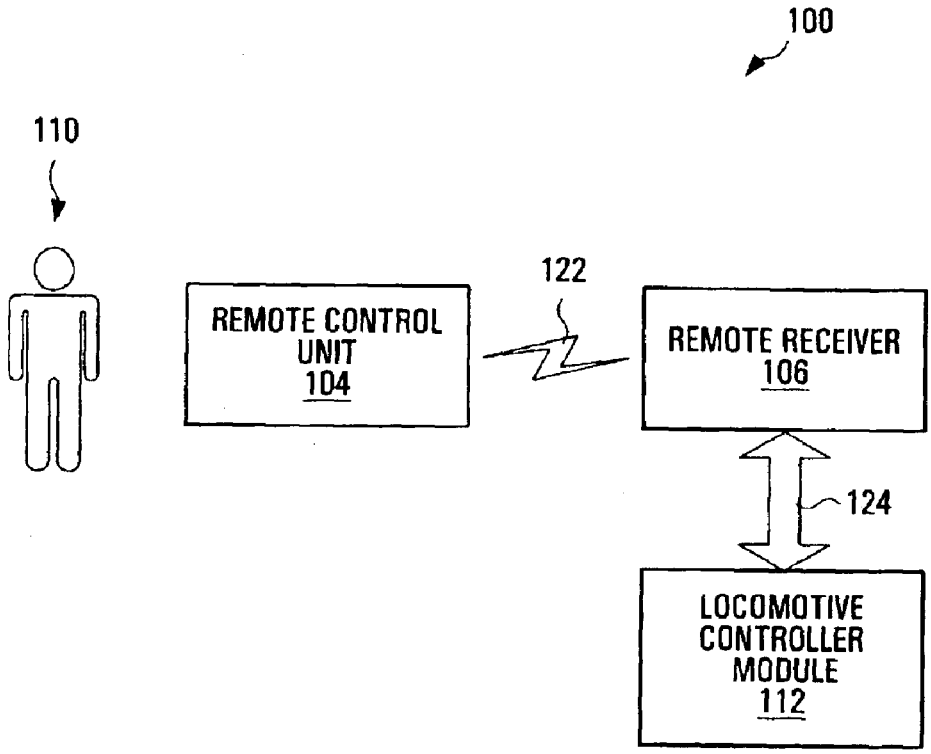
FIG. 1 is a simplified functional block diagram of a radio communication system for use in controlling a locomotive in accordance with a non-limiting example of implementation of the invention.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION

The detailed description below refers a radio control system and remote control device for remotely controlling a locomotive on a train. The skilled person in the art will appreciate that the processes and systems described herein below may also be applied radio control systems and associated remote control devices for remotely controlling other vehicles without detracting from the spirit of the invention.

Shown in FIG. 1 is a radio control system 100 in accordance with a specific example of implementation of the present invention suitable for use in controlling a locomotive. As shown, the radio control system 100 includes a set of functional units namely a remote control unit 104, a remote receiver 106 mounted on board the locomotive and a locomotive controller module 112.

The remote control unit 104 allows a user 110 to select a command among a set of available commands and transmits over RF link 122 a signal indicative of the selected command repetitively to create a succession of signal transmission events. The remote receiver 106 receives the signal from the remote control unit 104 and causes the associated command to be implemented at the locomotive. The implementation procedure consists of generating the proper control signals and interfacing those control signals with main controller module 112 provided in the locomotive to regulate the operation of the locomotive engine and braking system amongst others. The controller module 112 is part of the locomotive and will not be described further here.

The Remote Receiver 106

The remote receiver 106 is mounted onboard the locomotive and includes an interface module for communicating with the controller module 112 over communication link 124. Communication link 124 may be of any suitable format, including but not limited to an IR link, an RF link, a coaxial cable and copper wiring amongst others. The remote receiver is adapted to receive and demodulate a RF signal originating from the remote control unit 104. The demodulated signal is then decoded and the validity of the signal is verified. In a specific example the signal includes a message portion and a header portion. The header portion includes addressing information including an identifier associated with the remote control unit 104 and an identifier associated to the remote receiver 106. These components are extracted from the signal in a known manner. The validity verification on the signal then follows. Typically the validity verification is used to insure that the remote control unit 104 is permitted to issue commands to a given locomotive and to verify whether signal integrity has been maintained. Any suitable methods for validating a signal in a control system may be used here without detracting from the spirit of the invention. Such methods are well known in the field of remote control systems and as such will not be described further here.

When the remote control unit 104 and remote receiver 106 are used in a system demanding a high level of confidence, such as is the case for locomotive remote control systems, the remote receiver 106 is designed such as to expect a signal originating from the remote control unit 104 to be successfully received within a pre-determined time-out interval. If such as signal is not received within the predetermined time-out interval, the remote receiver 106 assumes that a problem has occurred and a default emergency action is executed. For example, the remote receiver 106 onboard a locomotive will issue a "brake" instruction if it has failed to successfully receive a message from the remote control unit 104 within a time interval T. In a non-limiting implementation, the time interval T is 5 seconds. It will be appreciated that for control system where the level of confidence need not be high, the time-out interval may be longer.

The Remote Control Unit 104

Figure 2:
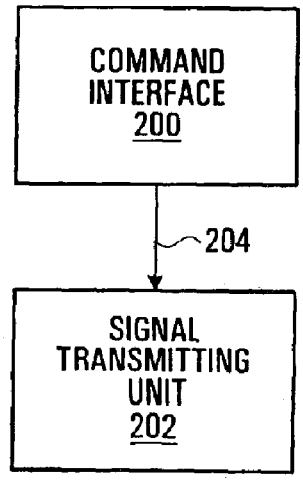
FIG. 2 is a functional block diagram of a remote control unit suitable for use in connection with the radio communication system of FIG. 1 in accordance with a non-limiting example of implementation of the invention.

The remote control unit 104 may be mounted either onboard the locomotive, mounted in a location which is off the locomotive or alternatively, may be a portable device. The remote control unit 104 of the radio control system 100 is shown in more detail in FIG. 2. The remote control unit includes a command interface 200 and a signal transmitting unit 202.

The Command Interface 200

The command interface 200 allows an operator to select a command among a set of available commands. The set of available commands includes commands that are typically performed by a locomotive including but not limited to brake, accelerate and reverse amongst others. Any suitable interface may be used for allowing a user to input a command for transmission to the remote receiver 106 onboard the locomotive.

In a first non-limiting example of implementation, the command interface 200 is manually operable. The command interface 200 may be of any suitable configuration allowing the user to manually provide commands. In a non-limiting example of implementation, the manually operable command interface may include input facilitators such as a pointing device, keyboard, levers, switches, a touch sensitive screen, buttons and knobs amongst others.

In a second non-limiting example of implementation, the command interface is voice operated. In this second implementation, the command interface may be of a configuration allowing the user to input commands through a voice input by formulating a command in the form of a spoken utterance. In such an implementation, the remote control unit includes a speech recognition engine that attempts to match the spoken utterance to a vocabulary item indicative of a command in a speech recognition dictionary. The speech recognition engine then releases the recognized command. Any suitable speech recognition method may be used.

In a third non-limiting implementation, the command interface 200 includes a combination of manually operable inputs and a voice input. In this third implementation, the user may be enabled to enter any command either manually or by voice input. Alternatively, certain commands may be available as voice input or manually input only.

The command interface 200 provides the selected command to the signal transmitting unit 202 over link 204.

The Signal Transmitting Unit 202

The signal transmitting unit 202 receives the selected command and is operative to transmit a signal indicative of the command selected at the command interface 200 repetitively to create a succession of signal transmission events. Each signal transmission event is spaced in time from a previous signal transmission event by a certain time interval and each signal transmission event has a certain power level.

FIRST EXAMPLE OF IMPLEMENTATION

In a first example of implementation, the duration of the certain time interval is conditioned at least in part on the basis of the selected command.

Figure 3:
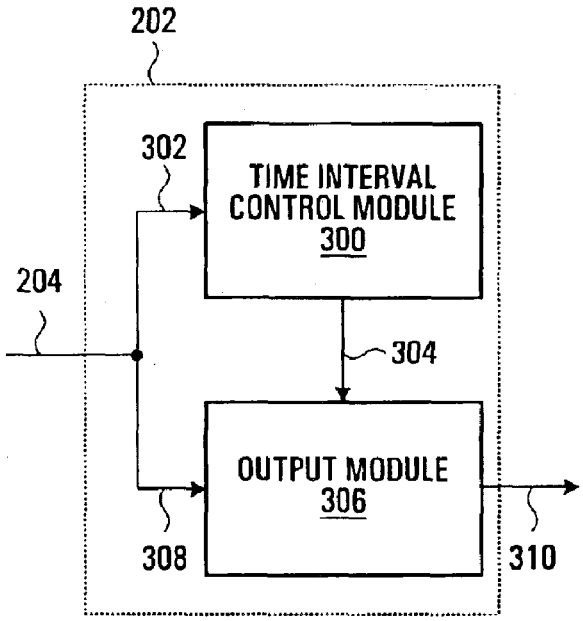
FIG. 3 is a functional block diagram of a signal transmitting unit suitable for use in the remote control unit shown in FIG. 2 in accordance with in accordance with a non-limiting example of implementation of the invention.

The signal transmitting unit 202 according to the first example of implementation is shown in more detail in FIG. 3. As depicted, the signal transmitting unit 202 includes a time interval duration control module 300 and an output module 306.

The time interval duration control module 300 has an input 302 to receive at least one parameter indicative of the selected command. Optionally, the time interval duration control module 300 may also include additional inputs for receiving additional parameters without detracting from the spirit of the invention. Such additional parameters may include the number of remote control unit/remote receiver pairs operating on a given frequency, a priority factor and any other suitable parameter that may effect the duration of a time interval. For the purpose of simplicity, the time interval duration control module 300 is being described as receiving a single parameter indicative of the selected command as an input.

The time interval duration control module 300 derives a duration data element at least in part on the basis of the parameter derived from the selected command and releases the duration data element at output 304. Examples of the manner in which the duration data element may be derived at least in part on the basis of the selected command will be described later on in the specification.

The output module 306 has a first input 308 to receive a signal indicative of the selected command, a second input for receiving the duration data element released at output 304 of the duration control module and an output 310 for releasing an RF signal indicative of the selected command repetitively to create a succession of signal transmission events.

Figure 4:
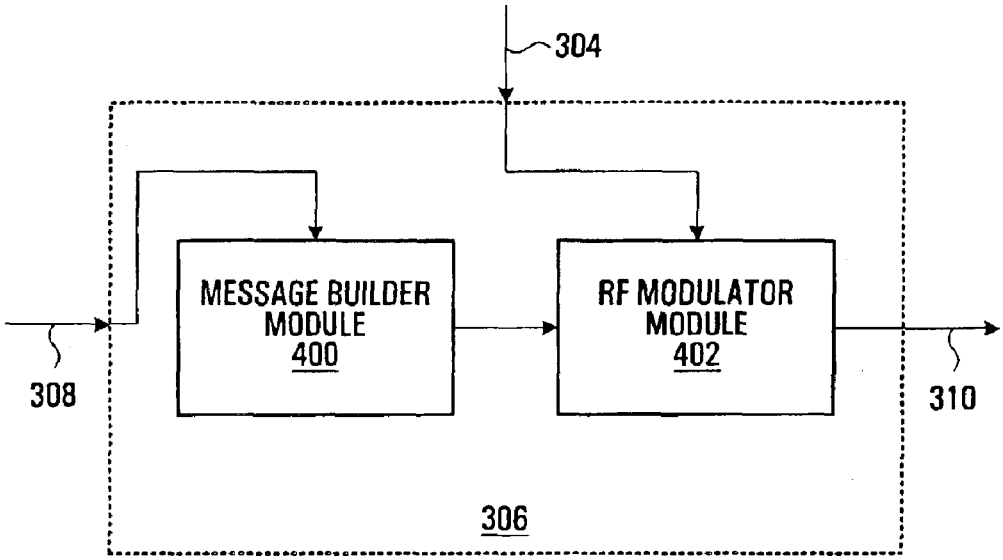
FIG. 4 is a functional block diagram of an output module suitable for use in the signal transmitting unit shown in FIG. 3 in accordance with a non-limiting example of implementation of the invention.

A non-limiting example of the output module 306 is depicted as a simplified block diagram in FIG. 4 of the drawings. As shown, the output module 306 includes a message builder module and an RF modulator 402.

The message builder 400 receives the selected command from input 308 and assembles a command packet. Many command packet formats may be used here and the use of a particular command packet format does not detract from the spirit of the invention. Typically, the command packet includes a header portion and a message portion. The header portion includes control information including addressing and verification data and the message portion includes data indicative of the selected command. Any suitable header portion configuration may be used here without detracting from the spirit of the invention. In a non-limiting implementation, the header portion includes addressing information including an identifier associated with the remote control unit 104 (shown in FIG. 1) and an identifier associated to the remote receiver 106. These two identifiers are stored in computer readable storage media at the remote control unit 104. Optionally, in addition to addressing information, the header portion may include synchronization data elements and error checking data. Many suitable encoding methods for providing synchronization data elements and error checking data are known in the art of digital signal processing and as such will not be described in further detail here. In a non-limiting implementation, the command packet is in a digital format.

Optionally, the size of the message portion of the command packet is dependent upon the selected command. In other words, not all commands make use of packets of the same size. Advantageously, this allows uses the amount of space necessary for a given command without sending out useless bits of information. Consequently, fewer data elements are transmitting resulting in lower bandwidth use.

Once the command packet has been created, the command packet is released for processing by the RF modulator module 402.

The RF modulator 402 repeatedly generates a modulated signal indicative of the command packet including the selected command thereby creating a succession of modulated signals. More specifically, the RF modulator module 402 modulates at a desired carrier frequency the command packet including the selected command. The operator of the remote control unit may select via the command interface 200 (shown in FIG. 2) the carrier frequency for the modulated signals. Alternatively, the carrier frequency may be determined at the time the remote control unit 104 is configured. In a specific non-limiting example, the radio frequency used by the remote control unit 104 is between 806 MHz and 821 MHz (low band) or between 851 MHz and 866 MHz (High band). However, any suitable frequency band may be used by the remote control unit 104 without detracting from the spirit of the invention. Following the modulation of the signal, the RF modulator module 402 transmits the modulated signal at certain time intervals. Each modulated signal corresponds to a respective signal transmission event in the succession of signal transmission events. Each signal transmission event is spaced in time from a previous signal transmission event by a certain time interval characterized by a duration, the duration of the certain time interval being determined on the basis of the duration data element received at the second input from the time interval duration control module 300. In other words the duration data element released by the time interval duration control module 300 controls the time interval between two successive transmissions of the signal.

The Time Interval Duration Control Module 300

The duration data elements that the output unit 306 uses are generated by the time interval duration control module 300.

Figure 5A:
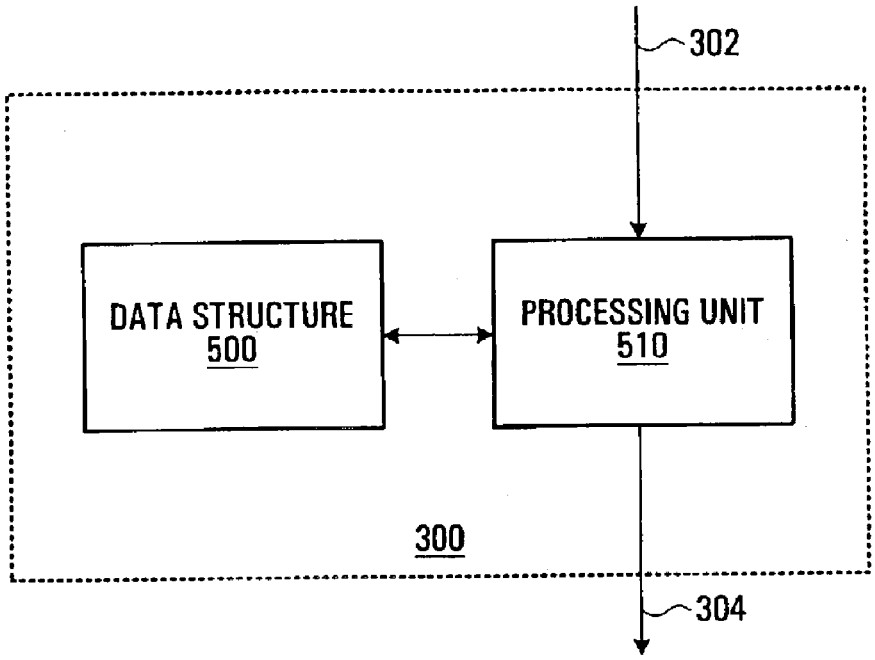
FIGS. 5*a*, 5*b*, 5*c* and 5*d* are functional block diagrams depicting examples of implementation of a time interval control module suitable for use in the signal transmitting unit shown in FIG. 3 in accordance with non-limiting examples of implementation of the invention.

In a specific example of implementation, as depicted in FIG. 5*a*, the time interval duration control module 300 includes a data structure 500 associating a command to a corresponding duration data element. The time interval duration control module 300 also includes a processing unit 510 adapted for processing the selected command received at input 302 to extract from the data structure 500 a duration data element corresponding to the selected command. The processing unit 510 then releases at output 304 the duration data element. The data structure 500 is stored on a computer readable storage medium part of the time interval control module 300 such as a ROM, PROM, disk or any other suitable machine readable storage means. Many suitable forms for the data structure are possible. For the purpose of simplicity, this specification will describe various specific examples of implementation where the data structure is in the form of a table. It will be appreciated by those skilled in the art that data structures other than tables may be used here without detracting from the spirit of the invention.

Figure 5B:
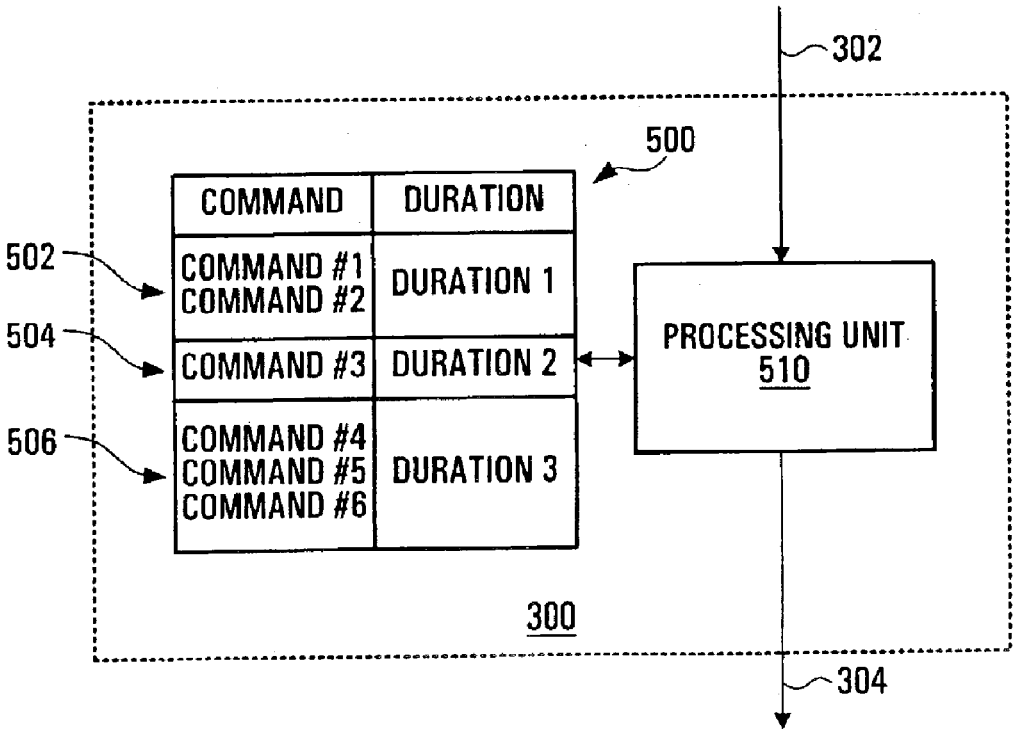

In a first specific example of implementation, as shown in FIG. 5*b*, the data structure is in the form of a table 500 having a plurality of entries 502 504 506, where each entry associates one or more commands to a corresponding duration data element. The processing unit 510 processes the selected command received at input 302 to locate the entry in the data structure 500 corresponding to the selected command. Once the entry is located, the corresponding duration data element is extracted from the data structure and released at output 304. In this fashion the time interval duration control module 300 controls the time interval between the successive transmission events generated by output module 306. In this first specific example, for a given command, the time interval between two consecutive signal transmission events is constant.

Figure 5C:
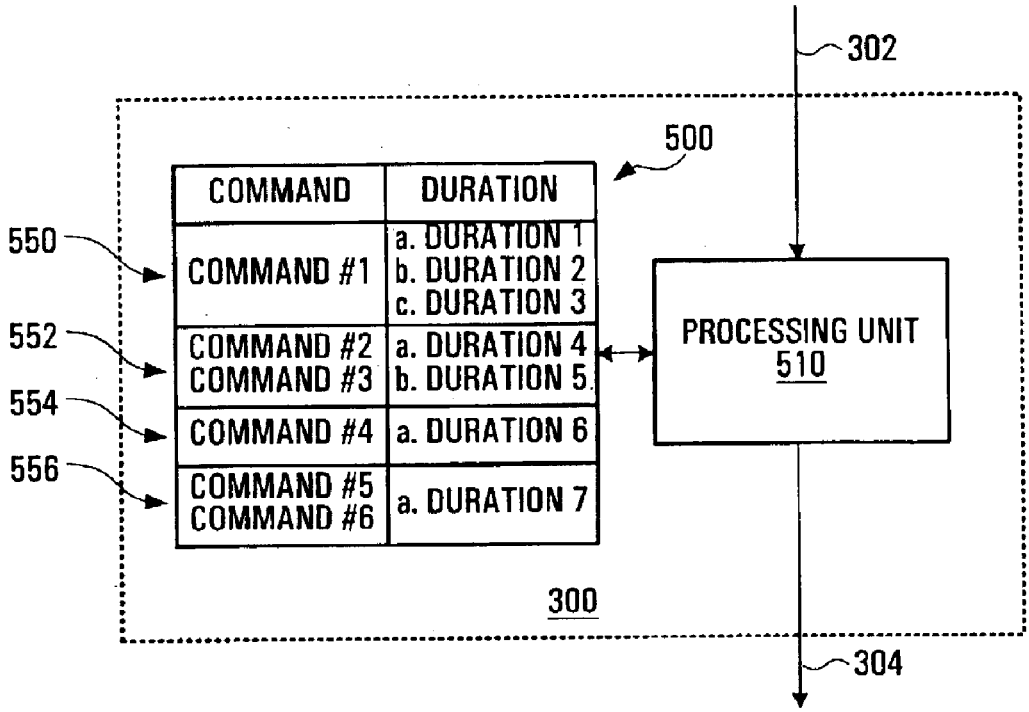

In a second specific example of implementation, as shown in FIG. 5*c*, the data structure is in the form of a table 500 having a plurality of entries 550 552 554 556, where each entry associates one or more commands to a set of one or more corresponding duration data elements. The processing unit 510 processes the selected command received at input 302 to locate the entry in the data structure 500 corresponding to the selected command. Once the entry is located, a duration data element from the set of corresponding data elements is processed to select one duration data element from the set. The one or more corresponding duration data elements are stored in each entry in sub-data structures. The sub-data structure may be in the form of a stored list, a table, a circular buffer or any other data structure suitable for the storage of a plurality of values. In a preferred embodiment, a circular buffer is used with a link or pointer indicating the next duration data element to be used for the entry in the sub-data structure. In another preferred embodiment, sequential memory locations in a buffer are used with a memory space containing the address of the next duration data element, herein referred to as pointer. Every time a signal transmission event occurs for a given entry, the link or pointer is displaced to the next duration data element. The selected duration data element is extracted from the sub-data structure and released at output 304. In this fashion the time interval duration control module 300 controls the time interval between the successive transmission events generated by output module 306. In this second specific example, for a given command, the time interval between two consecutive signal transmission events can vary.

Figure 5D:
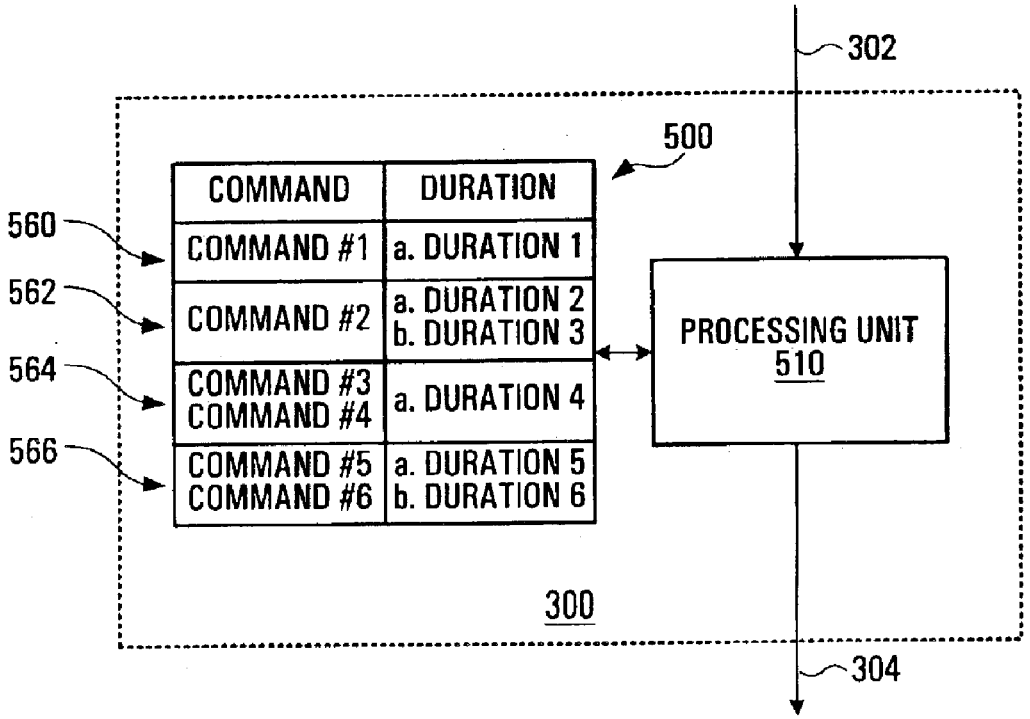

In a third specific example of implementation, as shown in FIG. 5*d*, the data structure is in the form of a table 500 having a plurality of entries 560 562 564 566, where at least some entries associate one or more commands to two or more corresponding duration data elements. The processing unit 510 processes the selected command received at input 302 to locate the entry in the data structure 500 corresponding to the selected command. Once the entry is located, when there are two or more corresponding duration data elements, the processing unit selects, during a first time segment, a first duration data element, during a second time segment, a second duration data element and so on. The length of each time segment may be monitored by a counter (not shown) part of the time interval duration control module 300. When the length of a time interval is reached, the new time segment in initiated and the corresponding duration data element is selected. This allows for example, a newly specified command to be sent more frequently (shorter time interval duration) during a first initial time segment and then less frequently (longer time interval duration) afterwards during a second time segment by selecting appropriate corresponding duration data elements. In this first specific example, for a given command, the time interval between two consecutive signal transmission events is constant within the first time interval and the time interval between two consecutive signal transmission events is constant during the second time interval.

It will be apparent that a time segment need not be limited to a specific length. For example, a first time segment may have a duration of X seconds and a second time segment subsequent to the first time segment may apply indefinitely until the command is changed. The length of the time segments may be the same for all command or may be command specific. In a non-limiting example where the length of the first time segment is command specific, the length of the first time segment is stored in the data structure entry in data structure 500 corresponding to the command. Each time a new command is selected by the user, the counter (not shown) is reset to take on the value of the length of the first time segment. Alternatively, where the length of the time segment is not command specific, each time a new command is selected by the user, the counter (not shown) is reset to take on a reference length of the time segment. For example, when a train command is for instructing a locomotive to remain parked, during a first time segment until a predetermined amount of time, the time interval between transmission events is set of a first duration. When the period of time during which the parked command is being transmitted exceeds a predetermined amount of time, the time interval between transmission events is set of a second duration. Advantageously, the second duration may be set to be longer than the first duration such as to reduce the bandwidth use without consequence to the safety of the locomotive. Although the above described example described two time segments, it will be appreciated that time segment in excess of two are possible without detracting from the spirit of the invention, each time segment have a respective length and being associated to a respective duration data element.

As a variant, the time interval duration control module 300 is adapted to release during a first time segment, a first duration data element and during a second time segment, a second duration data element irrespective of the selected command. In this alternative, each time a new command is selected by the user, the counter (not shown) is reset to take on a reference length of the time segment. In this variant, the time interval between consecutive signal transmission event is dependent on the duration of time a same command is being transmitted. This allows for example, a newly specified command to be sent more frequently (shorter time interval duration) during a first initial time segment and then less frequently (longer time interval duration) afterwards during a second time segment.

In a specific implementation, the data structure 500 associates for each command a duration data element that takes into account the level of importance of the command. The level of importance of a command may be assigned by the designer of the system or may be established by regulating organizations. In a specific example of implementation, each command in the set of available commands is associated to a duration data element at least in part on the basis of the level of importance of the command. In a non-limiting example, when the level of importance of a first command is lower than the level of importance of a second command, the duration of the time interval between transmission events for the first command is set to be longer than the duration of the time interval between transmission events for the second command. As such commands of lesser importance are sent less frequently than commands of a greater importance. For example, a parked command instructing a locomotive to remain parked can be associated to a lower level of importance that an emergency brake command instructing a locomotive to apply the emergency brakes. Therefore, the duration of the time intervals for the transmission of the parked command can be set to be longer than the duration of the time intervals for the transmission of the emergency brake command. The invention allows commands that are critical to the safety of the locomotive and its passengers to be transmitted at a higher transmission rate (shorter duration between transmission events) while commands that are not as critical are transmitted at a lower transmission rate (longer duration between transmission events). The use of a lower transmission rate allows a reduction in bandwidth usage.

SECOND EXAMPLE OF IMPLEMENTATION

In a second example of implementation, the length of the message portion of the signal transmission events is conditioned at least in part on the basis of the selected command.

Figure 6:
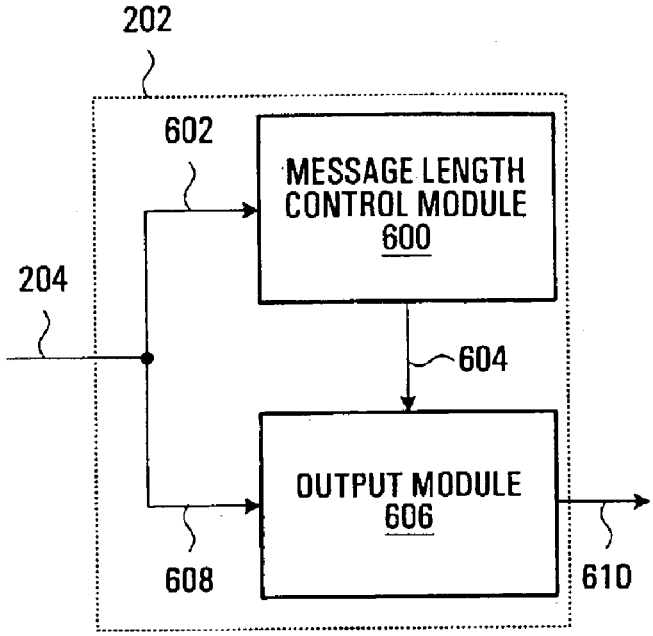
FIG. 6 is a functional block diagram of a signal transmitting unit suitable for use in the remote control unit shown in FIG. 2 in accordance with an alternative example of implementation of the invention.

The signal transmitting unit 202 according to the second example of implementation is shown in more detail in FIG. 6. As depicted, the signal transmitting unit 202 includes a message length control module 600 and an output module 606.

The message length control module 600 has an input 602 to receive at least one parameter indicative of the selected command. Optionally, message length control module 600 may also includes additional inputs for receiving additional parameters without detracting from the spirit of the invention. Such additional parameter may include the number of remote control unit/remote receiver pairs operating on a given frequency, a priority factor and any other suitable parameter that may effect the message length. For the purpose of simplicity, the message length control module 600 is being described as receiving a single parameter indicative of the selected command as an input.

The message length control module 600 derives a message length data element at least in part on the basis of the parameter derived from the selected command and releases the message length data element at output 604. Examples of the manner in which the message length data element may be derived at least in part on the basis of the selected command will be described later on in the specification.

The output module 606 has a first input 608 to receive a signal indicative of the selected command, a second input for receiving the message length data element released at output 604 of the message length control module 600 and an output 610 for releasing an RF signal indicative of the selected command repetitively to create a succession of signal transmission events.

Figure 11:
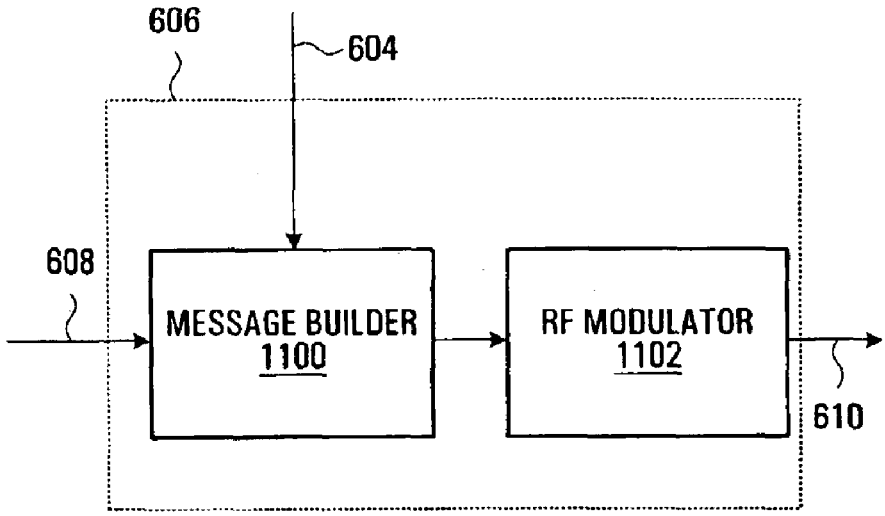
FIG. 11 is a functional block diagram of an output module suitable for use in the signal transmitting unit shown in FIG. 6 in accordance with a non-limiting example of implementation of the invention.

A non-limiting example of the output module 606 is depicted as a simplified block diagram in FIG. 11 of the drawings. As shown, the output module 606 includes a message builder module 1100 and an RF modulator 1102.

The message builder 1100 receives the selected command from input 608 and the message length data element at input 604 and assembles a command packet. Many command packet formats may be used here and the use of a particular command packet format does not detract from the spirit of the invention. Typically, the command packet includes a header portion and a message portion. The header portion includes control information including addressing and verification data and the message portion includes data indicative of the selected command. Any suitable header portion configuration may be used here without detracting from the spirit of the invention. In a non-limiting implementation, the header portion includes addressing information including an identifier associated with the remote control unit 104 (shown in FIG. 1) and an identifier associated to the remote receiver 106. These two identifiers are stored in computer readable storage media at the remote control unit 104. Optionally, in addition to addressing information, the header portion may include synchronization data elements and error checking data. Many suitable encoding methods for providing synchronization data elements and error checking data are known in the art of digital signal processing and as such will not be described in further detail here. In a non-limiting implementation, the command packet is in a digital format.

The size of the message portion of the command packet is dependent upon the selected command. In other words, not all commands make use of packets of the same size. Advantageously, this allows uses the amount of space necessary for a given command without sending out useless bits of information. Consequently, fewer data elements are transmitting resulting in lower bandwidth use. In addition, the size of the message portion may be conditioned on the basis of the message length data element received at input 604 from the message length control module 600. In other words the message length data element released by the message length control module 600 controls the message length of the transmissions of the signal.

In a specific implementation, at least some commands are associated to sets of messages of various lengths, each message in a given set conveying the associated command. The message builder 1100 makes use of the message length data element received at input 604 from the message length control module 600 to select a message in a given set of messages corresponding to the selected command. For example, the "park" command may be associated to a first message having a first message length including the complete "park" command and a second message having a second message length for instructing the locomotive to repeat the previous commands providing the previous command was a "park" command. The length data element received at input 604 causes either one of the first message and the second message to be selected.

Once the command packet has been created, the command packet is released for processing by the RF modulator module 802.

The RF modulator 802 repeatedly generates a modulated signal indicative of the command packet including the selected command thereby creating a succession of modulated signals. More specifically, the RF modulator module 802 modulates at a desired carrier frequency the command packet including the selected command. Following the modulation of the signal, the RF modulator module 802 transmits the modulated signal at certain time intervals.

The Message Length Control Module 600

The message length data elements that the output unit 606 uses are generated by the message length control module 600. In a non-limiting implementation, the message length data element is expressed as an index corresponding to the message in the set of messages corresponding to a given command. It will be readily apparent that other manners of expressing message lengths may be used without detracting from the spirit of the invention.

Figure 12A:
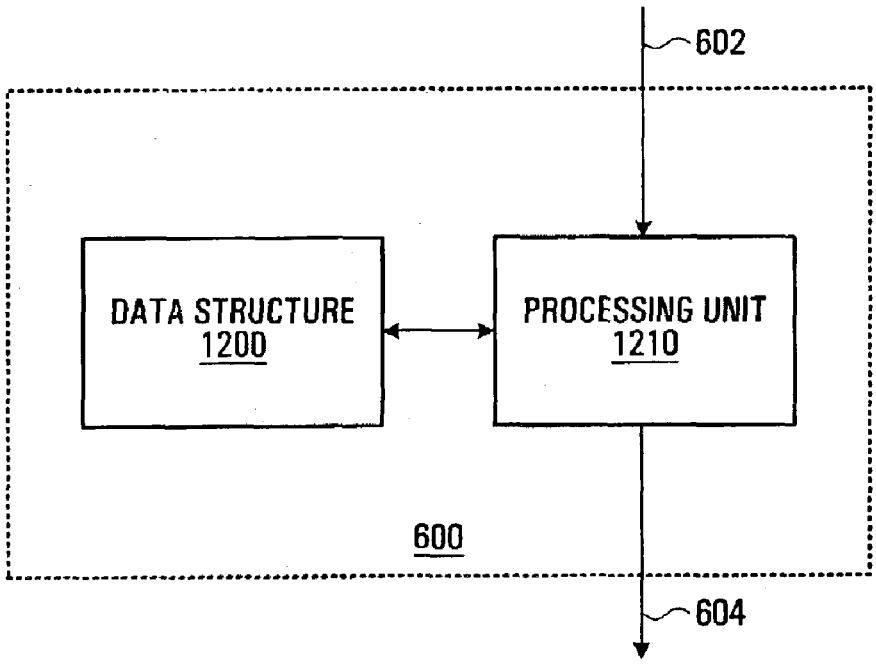
FIGS. 12*a*, and 12*b* are functional block diagrams depicting examples of implementation of a power level control module suitable for use in the signal transmitting unit shown in FIG. 6 in accordance with non-limiting examples of implementation of the invention.

In a specific example of implementation, as depicted in FIG. 12*a*, the message length control module 600 includes a data structure 1200 associating a command to a corresponding message length data element. The message length control module 600 also includes a processing unit 1210 adapted for processing the selected command received at input 302 to extract from the data structure 1200 a message length data element corresponding to the selected command. The processing unit 1210 then releases at output 304 the message length data element. The data structure 1200 is stored on a computer readable storage medium part of the time interval control module 300 such as a ROM, PROM, disk or any other suitable machine readable storage means. Many suitable forms for the data structure are possible. For the purpose of simplicity, this specification will describe various specific examples of implementation where the data structure is in the form of a table. It will be appreciated by those skilled in the art that data structures other than tables may be used here without detracting from the spirit of the invention.

Figure 12B:
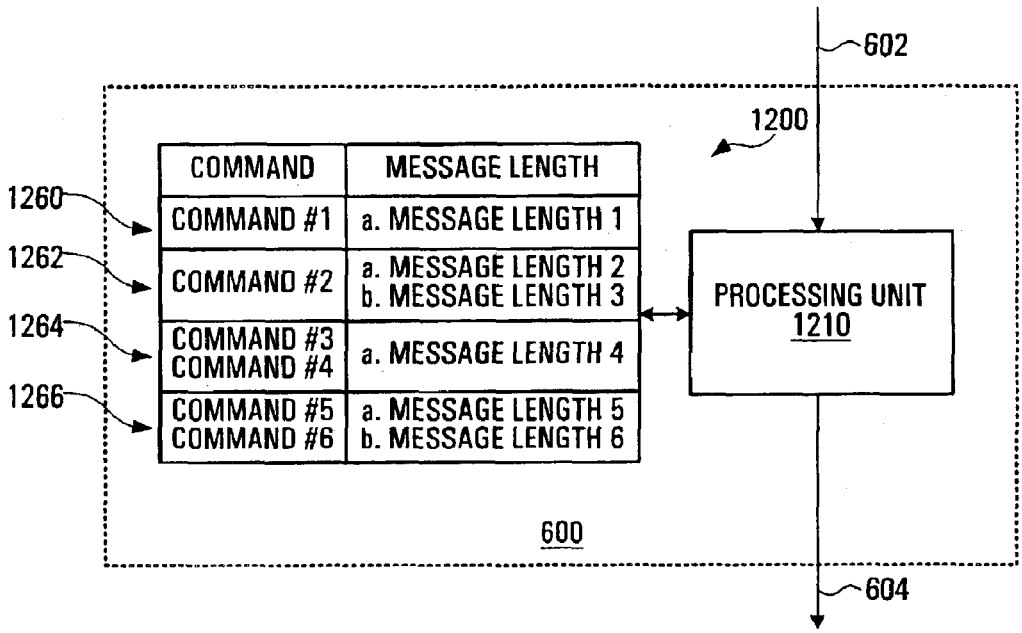

In a third specific example of implementation, as shown in FIG. 12*b*, the data structure is in the form of a table 1200 having a plurality of entries 1260 1262 1264 1266, where at least some entries associate one or more commands to one or more corresponding message length data elements. The processing unit 1210 processes the selected command received at input 302 to locate the entry in the data structure 1200 corresponding to the selected command. Once the entry is located, when there are two or more corresponding message length data elements, the processing unit selects, during a first time segment, a first message length data element, during a second time segment, a second message length data element and so on. The duration of each time segment may be monitored by a counter (not shown) part of the message length control module 600. When the duration of a time interval is reached, the new time segment in initiated and the corresponding message length data element is selected. This allows for example, a newly specified command to be sent with a longer (or shorter) message length during a first initial time segment and then at a shorter (or longer) message length by selecting appropriate corresponding message length data elements.

It will be apparent that a time segment need not be limited to a specific duration. For example, a first time segment may have a duration of X seconds and a second time segment subsequent to the first time segment may apply indefinitely until the command is changed. The duration of the time segments may be the same for all command or may be command specific. In a non-limiting example where the duration of the first time segment is command specific, the duration of the first time segment is stored in the data structure entry in data structure 500 corresponding to the command. Each time a new command is selected by the user, the counter (not shown) is reset to take on the value of the duration of the first time segment. Alternatively, where the duration of the time segment is not command specific, each time a new command is selected by the user, the counter (not shown) is reset to take on a reference duration of the time segment. For example, when a train command is for instructing a locomotive to remain parked, during a first time segment until a predetermined amount of time, the message length of the signal transmission events is set of a first message length. When the period of time during which the parked command is being transmitted exceeds a predetermined amount of time, the message length of the transmission events is set of a second message length. Advantageously, the second message length may be set to be shorter than the first message length such as to reduce the bandwidth used by the transmitting unit without consequence to the safety of the locomotive. Although the above described example described two time segments, it will be appreciated that time segment in excess of two are possible without detracting from the spirit of the invention, each time segment have a respective length and being associated to a respective message length data element.

In a specific implementation, the data structure 1200 associates for each command a message length data element that takes into account the level of importance of the command. The level of importance of a command may be assigned by the designer of the system or may be established by regulating organizations. In a specific example of implementation, each command in the set of available commands is associated to a message length data element at least in part on the basis of the level of importance of the command. In a non-limiting example, when the level of importance of a first command is lower than the level of importance of a second command, the message length of the transmission events for the first command is set to be lower than the message length of the transmission events for the second command. As such commands of lesser importance are sent at a shorter message length than commands of a greater importance. For example, a parked command instructing a locomotive to remain parked can be associated to a lower level of importance that an emergency brake command instructing a locomotive to apply the emergency brakes. Therefore, the message length for the transmission of the parked command can be set to be lower than the message length for the transmission of the emergency brake command.

As a variant, the message length control module 600 is adapted to release during a first time segment, a first message length data element and during a second time segment, a second message length data element irrespective of the selected command. In this alternative, each time a new command is selected by the user, the counter (not shown) is reset to take on a default duration. In this variant, the message length of the signal transmission event is dependent on the duration of time a same command is being transmitted. This allows for example, a newly specified command to be sent with a first message length during a first initial time segment and then at a second message length afterwards during a second time segment.

The invention allows commands that are critical to the safety of the locomotive and its passengers to be transmitted at a longer message length while commands that are not as critical are transmitted with a shorter message length. The use of a shorter message length allows for a more efficient bandwidth usage to be achieved. This is particularly advantageous where the remote control unit is battery operated.

THIRD EXAMPLE OF IMPLEMENTATION

In a third example of implementation, the power levels of the signal transmission events generated by the signal transmitting unit 202 are conditioned at least in part on the basis of the selected command.

Figure 7:
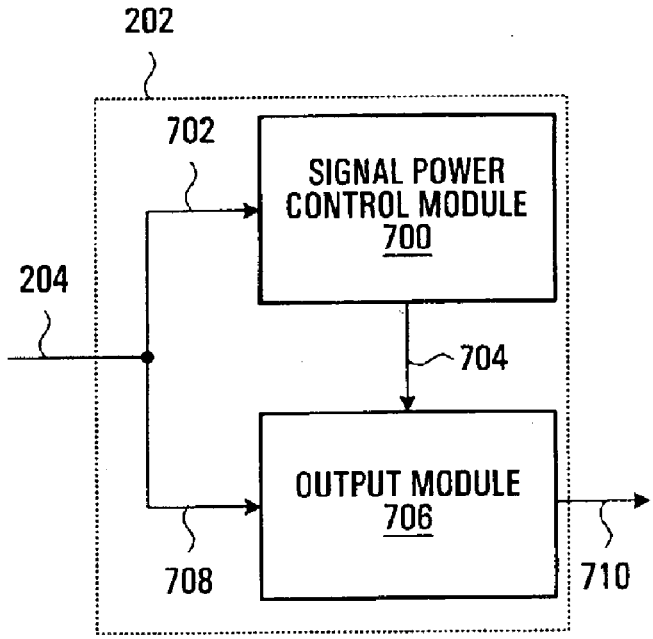
FIG. 7 is a functional block diagram of a signal transmitting unit suitable for use in the remote control unit shown in FIG. 2 in accordance with another alternative example of implementation of the invention.

The signal transmitting unit 202 according to the third example of implementation is shown in more detail in FIG. 7. As depicted, the signal transmitting unit 202 includes a signal power level control module 700 and an output module 706.

The signal power level control module 700 has an input 702 to receive at least one parameter indicative of the selected command. Optionally, the signal power level control module 700 may also includes additional inputs for receiving additional parameters without detracting from the spirit of the invention. Such additional parameters may include the number of remote control unit/remote receiver pairs operating on a given frequency, a priority factor and any other suitable parameter that may effect the power level of a transmission. For the purpose of simplicity, the time signal power level control module 700 is being described as receiving a single parameter indicative of the selected command as an input.

The signal power level control module 700 derives a power level data element at least in part on the basis of the parameter derived from the selected command and releases the power level data element at output 704. Examples of the manner in which the power level data element may be derived at least in part on the basis of the selected command will be described later on in the specification.

The output module 706 has a first input 708 to receive a signal indicative of the selected command, a second input for receiving the power level data element released at output 704 of the signal power level control module 700 and an output 710 for releasing an RF signal indicative of the selected command repetitively to create a succession of signal transmission events.

Figure 8:
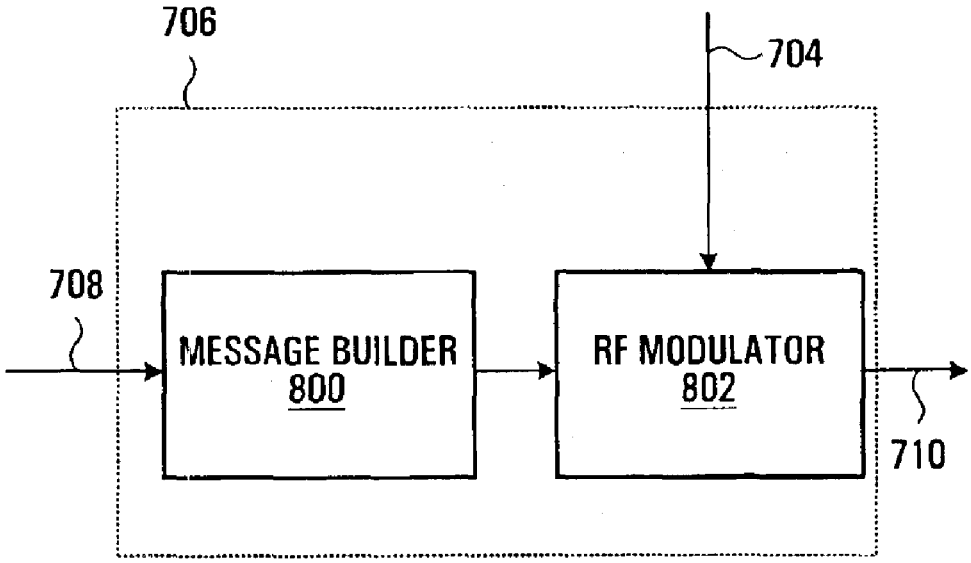
FIG. 8 is a functional block diagram of an output module suitable for use in the signal transmitting unit shown in FIG. 7 in accordance with a non-limiting example of implementation of the invention.

A non-limiting example of the output module 706 is depicted as a simplified block diagram in FIG. 8 of the drawings. As shown, the output module 706 includes a message builder module 800 and an RF modulator 802.

The message builder 800 receives the selected command from input 308 and assembles a command packet and may be implemented in a manner similar to message builder 400 described in connection with FIG. 4. Once the command packet has been created, the command packet is released for processing by the RF modulator module 802.

The RF modulator 802 repeatedly generates a modulated signal indicative of the command packet including the selected command thereby creating a succession of modulated signals. More specifically, the RF modulator module 802 modulates at a desired carrier frequency the command packet including the selected command. Following the modulation of the signal, the RF modulator module 802 transmits the modulated signal at certain time intervals. Each modulated signal corresponds to a respective signal transmission event in the succession of signal transmission events. Each signal transmission event has a respective signal power level, the signal power level being determined on the basis of the power level data element received at the second input from the signal power level control module 700. In other words the power level data element released by the power level control module 700 controls the power level of the transmissions of the signal.

The Signal Power Level Control Module 700

The power level data elements that the output unit 706 uses are generated by the time power level control module 700.

Figure 9A:
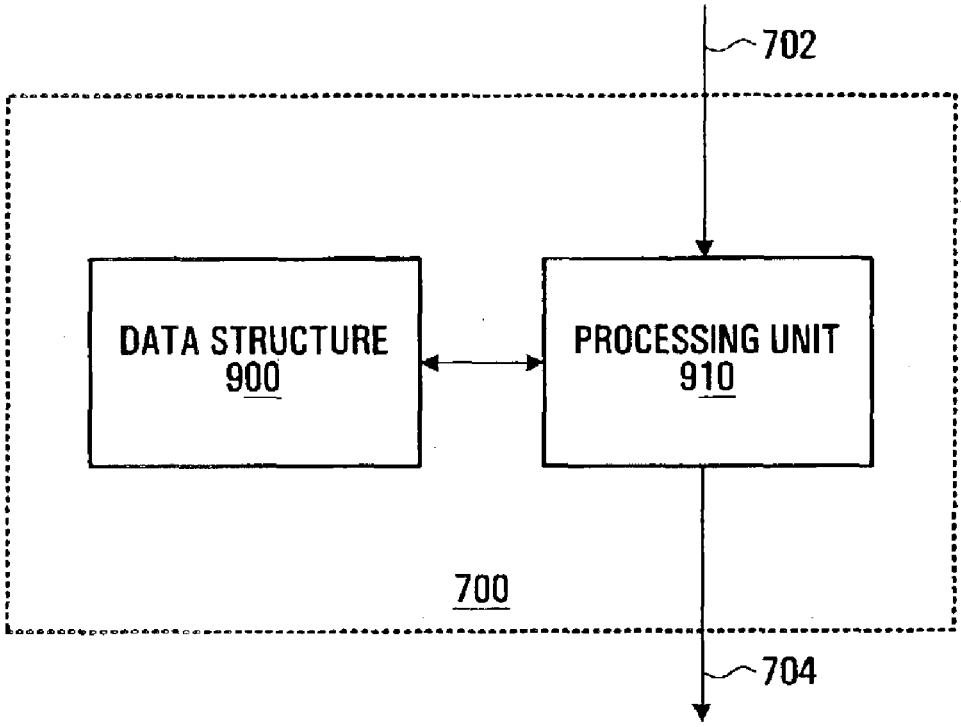
FIGS. 9*a*, 9*b*, 9*c* and 9*d* are functional block diagrams depicting examples of implementation of a power level control module suitable for use in the signal transmitting unit shown in FIG. 7 in accordance with non-limiting examples of implementation of the invention.

In a specific example of implementation, as depicted in FIG. 9*a*, the power level control module 700 includes a data structure 900 associating a command to a corresponding power level data element. The power level control module 700 also includes a processing unit 910 adapted for processing the selected command received at input 302 to extract from the data structure 900 a power level data element corresponding to the selected command. The processing unit 910 then releases at output 304 the power level data element. The data structure 900 is stored on a computer readable storage medium part of the time interval control module 300 such as a ROM, PROM, disk or any other suitable machine readable storage means. Many suitable forms for the data structure are possible. For the purpose of simplicity, this specification will describe various specific examples of implementation where the data structure is in the form of a table. It will be appreciated by those skilled in the art that data structures other than tables may be used here without detracting from the spirit of the invention.

Figure 9B:
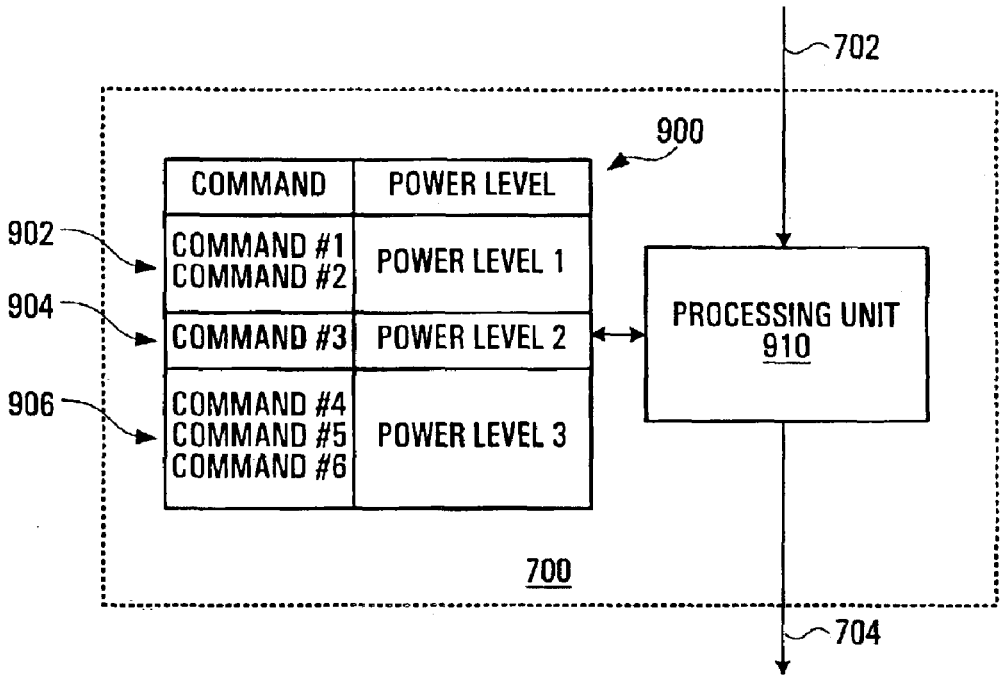

In a first specific example of implementation, as shown in FIG. 9*b*, the data structure is in the form of a table 900 having a plurality of entries 902 904 906, where each entry associates one or more commands to a corresponding power level data element. The processing unit 910 processes the selected command received at input 302 to locate the entry in the data structure 900 corresponding to the selected command. Once the entry is located, the corresponding power level data element is extracted from the data structure and released at output 304. In this fashion the power level control module 700 controls the power level of the transmission events generated by output module 706. In this first specific example, for a given command, the power level of two consecutive signal transmission events is constant.

Figure 9C:
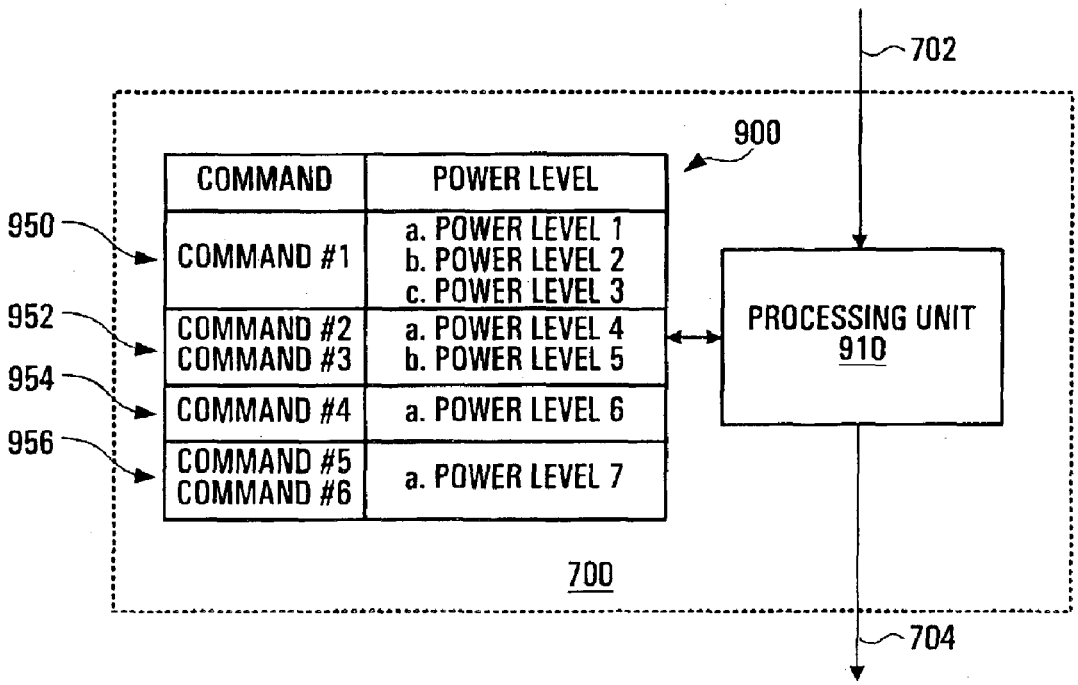

In a second specific example of implementation, as shown in FIG. 9*c*, the data structure is in the form of a table 900 having a plurality of entries 950 952 954 956, where each entry associates one or more commands to a set of one or more corresponding power level data elements. The processing unit 910 processes the selected command received at input 702 to locate the entry in the data structure 900 corresponding to the selected command. Once the entry is located, a power level data element from the set of corresponding data elements is processed to select one power level data element from the set. The one or more corresponding power level data elements are stored in each entry in sub-data structures. The sub-data structure may be in the form of a stored list, a table, a circular buffer or any other data structure suitable for the storage of a plurality of values. In a preferred embodiment, a circular buffer is used with a link or pointer indicating the next power level data element to be used for the entry in the sub-data structure. In another preferred embodiment, sequential memory locations in a buffer are used with a memory space containing the address of the next power level data element, herein referred to as pointer. Every time a signal transmission event occurs for a given entry, the link or pointer is displaced to the next power level data element. The selected power level data element is extracted from the sub-data structure and released at output 704. In this fashion the time power level control module 700 controls the power level of the successive transmission events generated by output module 706. In this second specific example, for a given command, the power level between two consecutive signal transmission events may vary.

Figure 9D:
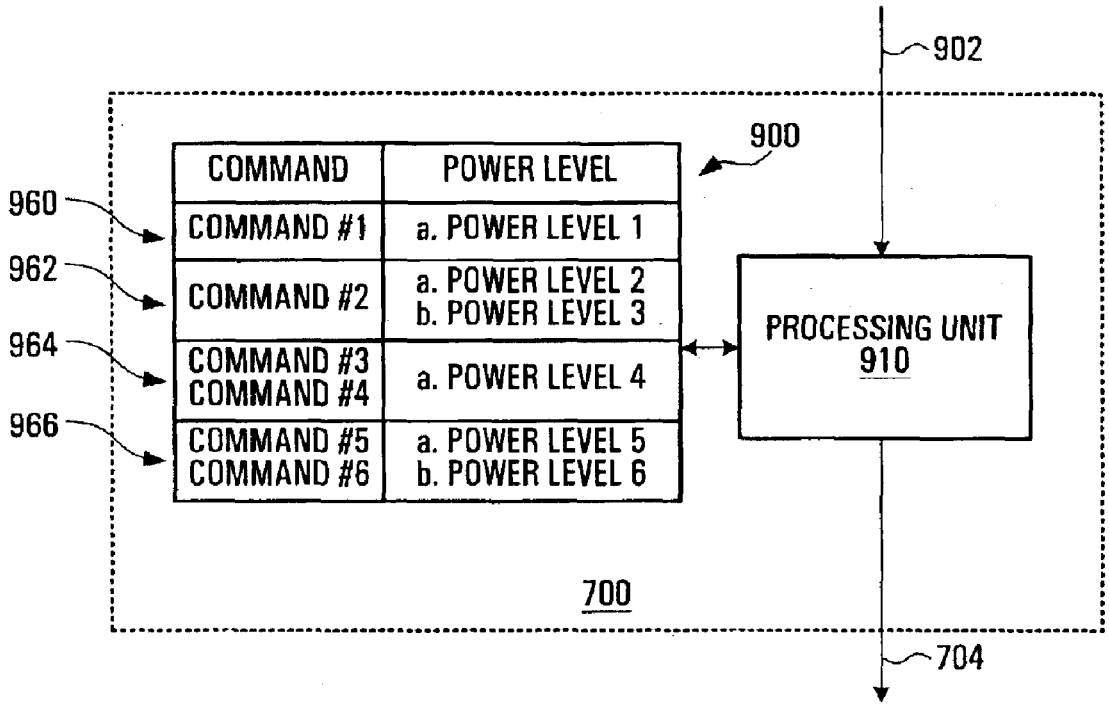

In a third specific example of implementation, as shown in FIG. 9*d*, the data structure is in the form of a table 900 having a plurality of entries 960 962 964 966, where at least some entries associate one or more commands to two or more corresponding power level data elements. The processing unit 910 processes the selected command received at input 302 to locate the entry in the data structure 900 corresponding to the selected command. Once the entry is located, when there are two or more corresponding power level data elements, the processing unit selects, during a first time segment, a first power level data element, during a second time segment, a second power level data element and so on. The length of each time segment may be monitored by a counter (not shown) part of the power level control module 700. When the length of a time interval is reached, the new time segment in initiated and the corresponding power level data element is selected. This allows for example, a newly specified command to be sent at a greater power level during a first initial time segment and then at a lower power level by selecting appropriate corresponding power level data elements. In this specific example, for a given command, the power level of the signal transmission events is constant within the first time interval and within the second time interval.

It will be apparent that a time segment need not be limited to a specific length. For example, a first time segment may have a duration of X seconds and a second time segment subsequent to the first time segment may apply indefinitely until the command is changed. The length of the time segments may be the same for all command or may be command specific. In a non-limiting example where the length of the first time segment is command specific, the length of the first time segment is stored in the data structure entry in data structure 500 corresponding to the command. Each time a new command is selected by the user, the counter (not shown) is reset to take on the value of the length of the first time segment. Alternatively, where the length of the time segment is not command specific, each time a new command is selected by the user, the counter (not shown) is reset to take on a reference length of the time segment. For example, when a train command is for instructing a locomotive to remain parked, during a first time segment until a predetermined amount of time, the power level of the signal transmission events is set of a first power level. When the period of time during which the parked command is being transmitted exceeds a predetermined amount of time, the power level of the transmission events is set of a second power level. Advantageously, the second power level may be set to be lower than the first power level such as to reduce the required power utilization of the transmitting unit without consequence to the safety of the locomotive. Although the above described example described two time segments, it will be appreciated that time segment in excess of two are possible without detracting from the spirit of the invention, each time segment have a respective length and being associated to a respective power level data element.

As a variant, the power level control module 700 is adapted to release during a first time segment, a first power level data element and during a second time segment, a second power level data element irrespective of the selected command. In this alternative, each time a new command is selected by the user, the counter (not shown) is reset to take on a reference length of the time segment. In this variant, the power level of the signal transmission event is dependent on the duration of time a same command is being transmitted. This allows for example, a newly specified command to be sent at a higher power level during a first initial time segment and then at a lower power level afterwards during a second time segment.

In a specific implementation, the data structure 900 associates for each command a power level data element that takes into account the level of importance of the command. The level of importance of a command may be assigned by the designer of the system or may be established by regulating organizations. In a specific example of implementation, each command in the set of available commands is associated to a power level data element at least in part on the basis of the level of importance of the command. In a non-limiting example, when the level of importance of a first command is lower than the level of importance of a second command, the power level of the transmission events for the first command is set to be lower than the power level of the transmission events for the second command. As such commands of lesser importance are sent at a lower power level than commands of a greater importance. For example, a parked command instructing a locomotive to remain parked can be associated to a lower level of importance that an emergency brake command instructing a locomotive to apply the emergency brakes. Therefore, the power level for the transmission of the parked command can be set to be lower than the power level for the transmission of the emergency brake command. The invention allows commands that are critical to the safety of the locomotive and its passengers to be transmitted at a higher power level while commands that are not as critical are transmitted at a lower power level. The use of a lower power level allows for more efficient power consumption for the remote control unit to be achieved. This is particularly advantageous where the remote control unit is battery operated.

Example of Specific Physical Implementations

Those skilled in the art should appreciate that in some embodiments of the invention, all or part of the functionality previously described herein with respect to the remote control unit 104 may be implemented as pre-programmed hardware or firmware elements (e.g., application specific integrated circuits (ASICs), electrically erasable programmable read-only memories (EEPROMs), etc.), or other related components.

In other embodiments of the invention, all or part of the functionality previously described herein with respect to the remote control unit 104 may be implemented as software consisting of a series of instructions for execution by a computing unit. The series of instructions could be stored on a medium which is fixed, tangible and readable directly by the computing unit, (e.g., removable diskette, CD-ROM, ROM, PROM, EPROM or fixed disk).

Figure 10:
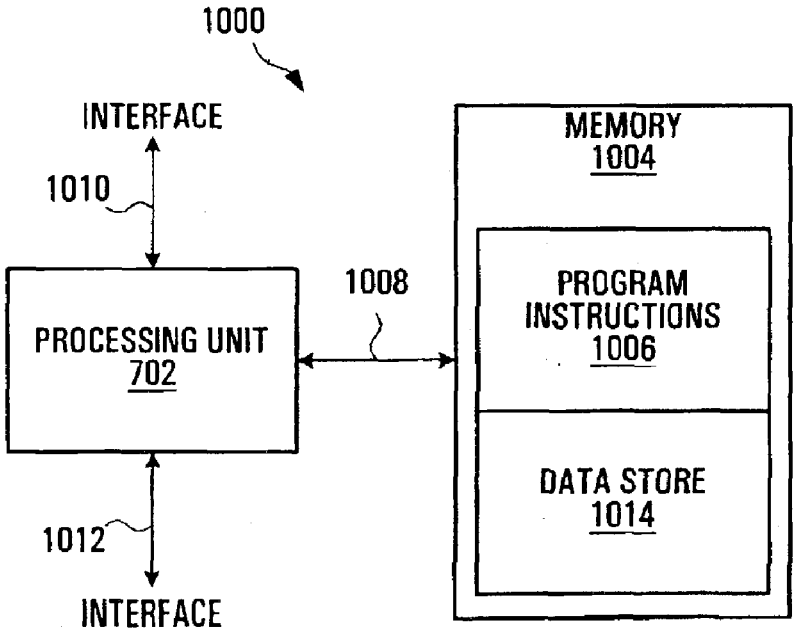
FIG. 10 is a block diagram of a specific example of implementation of a signal transmitting unit in accordance with an alternative example of implementation of the invention.

In a non-limiting implementation, either one of the time interval control module 300, the message length control module 600 and the signal power control module 700 may be implemented by a general-purpose computing platform 1000 of the type depicted in FIG. 10, including a processing unit 1002 and a memory 1004 connected by a communication bus 1008. The memory includes data 1014 and program instructions 1006. The processing unit 1002 is adapted to process the data 1014 and the program instructions 1006 in order to implement the functional blocks described in the specification and depicted in the drawings. In a non-limiting implementation, the program instructions 1006 implement the functionality of the time interval control module 300 described above and the data 1014 stores the data structure 500 (shown in FIG. 5*a*, 5*b*, 5*c* or 5*d*). In another non-limiting implementation, the program instructions 1006 implement the functionality of the power level control module 700 described above and the data 1014 stores the data structure 900 (shown in FIG. 9*a*, 9*b*, 9*c* or 9*d*). In yet another non-limiting implementation, the program instructions 1006 implement the functionality of the message length control module 600 described above and the data 1014 stores the data structure 1200 (shown in FIG. 12*a*, 12*b*).

The computing unit 1000 may also comprise a number of interfaces 1010 1012 for receiving or sending data elements to external modules. For example, interface 1010 may be used for receiving a selected command from the command interface 200 (shown in FIG. 2) and interface 1012 may be for releasing a duration data element for processing by an output module.

Those skilled in the art should further appreciate that the program instructions 706 may be written in a number of programming languages for use with many computer architectures or operating systems. For example, some embodiments may be implemented in a procedural programming language (e.g., "C"), an object oriented programming language (e.g., "C++" or "JAVA"), machine code or any other suitable language.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. A remote control unit for controlling a locomotive by transmitting signals to a remote receiver mounted onboard the locomotive, said remote control unit comprising:

a. an input for receiving a signal indicative of a command selected from a set of available commands;

b. a signal transmitting unit operative to transmit a signal indicative of the selected command repetitively to create a succession of signal transmission events, each signal transmission event being spaced in time from a previous signal transmission event by a certain time interval characterized by a duration, the duration of the certain time interval being conditioned at least in part on the basis of the selected command, said signal transmitting unit including an RF modulator adapted for modulating data indicative of the selected command to generate a succession of modulated signals, each modulated signal corresponding to a respective signal transmission event in the succession of signal transmission events.

2. A remote control unit as described in claim 1, said remote control unit further comprising a time interval duration control module for:

a. deriving a duration data element at least in part on the basis of the selected command; and b. supplying the duration data element to said signal transmitting unit for varying said time interval to alter a rate of occurrence of the transmission events on the basis of the selected command.

3. A remote control unit as described in claim 2, wherein commands in the set of available commands are associated to respective levels of importance, the duration data elements being conditioned at least in part on the basis of the level of importance of selected command.

4. A remote control unit as described in claim 3, wherein a first command is associated to a first level of importance and a second command being associated to a second level of importance, said second level of importance being indicative of a greater importance than said first level of importance, said interval duration control module being adapted to associate a first duration data element to said first command and a second duration data element to said second command, the second duration data element being indicative of a shorter duration than the first duration data element.

5. A remote control unit as described in claim 2, said interval duration control module includes:

a. a data structure associating a command to a corresponding duration data element;

b. a processing unit adapted for processing the selected command to extract from said data structure a certain duration data element corresponding to the selected command;

c. an output for providing the certain duration data element to said signal transmitting unit for varying said time interval to alter a rate of occurrence of the transmission events on the basis of the selected command.

6. A remote control unit as described in claim 2, said interval duration control module includes:

a. a data structure including a plurality of entries, each entry associating one or more commands to a set of corresponding duration data elements;

b. a processing unit adapted for processing the selected command to:

i. locate a certain entry associating the selected command and to a certain set of corresponding duration data elements;

ii. select at least one duration data element from the certain set of corresponding duration data elements;

c. an output for providing the at least one duration data element to said signal transmitting unit for varying said time interval to alter a rate of occurrence of the transmission events on the basis of the selected command.

7. A remote control unit as described in claim 6, wherein at least one entry in said data structure includes a circular buffer storing a set of duration data elements.

8. A remote control unit as described in claim 1, wherein said signal transmitting unit is operative to transmit said signal repetitively to create a succession of signal transmission events, wherein:

a. during a first time segment each signal transmission event is spaced in time from a previous signal transmission event by a certain time interval characterized by a first duration; and b. during a second time segment each signal transmission event is spaced in time from a previous signal transmission event by a certain time interval characterized by a second duration different from the first duration, at least one of the first duration and second duration being conditioned at least in part on the basis of the selected command.

9. A remote control unit as described in claim 1, wherein said remote control unit is portable.

10. A remote control unit as described in claim 9, comprising a command interface allowing an operator to select a command among a set of available commands, the command interface being manually operable.

11. A remote control unit as described in claim 9, comprising a command interface allowing an operator to select a command among a set of available commands, the command interface being voice operated.

12. A remote control unit for controlling a locomotive by transmitting signals to a remote receiver mounted onboard the locomotive, said remote control unit comprising:

a. an input for receiving a signal indicative of a command selected from a set of available commands;

b. a signal transmitting unit operative to transmit a signal indicative of the selected command repetitively to create a succession of signal transmission events, said signal transmission unit comprising:

i. a time interval duration control module having an input to receive at least one parameter, the at least one parameter being derived from the selected command, said time interval duration control module being operative for deriving at least one duration data element at least in part on the basis of the at least one parameter and for releasing the at least one duration data element at an output;

ii. an output module including an RE modulator adapted to output repeatedly a modulated signal indicative of the selected command to create a succession of modulated signals, each modulated signal corresponding to a respective signal transmission event in the succession of signal transmission events, each signal transmission event being spaced in time from a previous signal transmission event by a certain time interval characterized by a duration, the duration of the certain time interval being determined on the basis of the at least one duration data element.

13. A method for remotely controlling a locomotive, said method comprising:

a. enabling an operator to select a command among a set of available commands;

b. transmitting a signal indicative of the selected command repetitively to a receiver onboard the locomotive to create a succession of signal transmission events, each signal transmission event being spaced in time from a previous signal transmission event by a certain time interval characterized by a duration, the duration of the certain time interval being conditioned at least in part on the basis of the selected command.

14. A method as described in claim 13, said method further comprising:

a. deriving a duration data element at least in part on the basis of the selected command; and b. varying said time interval on the basis of the duration data element to alter a rate of occurrence of the transmission events on the basis of the selected command.

15. A method as described in claim 14, wherein commands in the set of available commands are associated to respective levels of importance, the duration data elements being conditioned at least in part on the basis of the level of importance of selected command.

16. A method as described in claim 15, wherein a first command is associated to a first level of importance and a second command being associated to a second level of importance, said second level of importance being indicative of a greater importance than said first level of importance, said method including associating a first duration data element to said first command and a second duration data element to said second command, the second duration data element being indicative of a shorter duration than the first duration data element.

17. A method as described in claim 14, said method further comprising:

a. providing a data structure associating a command to a corresponding duration data element;

b. processing the selected command to extract from said data structure a certain duration data element corresponding to the selected command;

c. varying said time interval on the basis of the duration data element to alter a rate of occurrence of the transmission events on the basis of the selected command.

18. A method as described in claim 14, said method further comprising:

a. providing a data structure including a plurality of entries, each entry associating one or more commands to a set of corresponding duration data elements;

b. processing the selected command to:

i. locate a certain entry associating the selected command and to a certain set of corresponding duration data elements;

ii. select at least one duration data element from the certain set of corresponding duration data elements;

c. varying said time interval on the basis of the duration data element to alter a rate of occurrence of the transmission events on the basis of the selected command.

19. A method as described in claim 18, wherein at least one entry in said data structure includes a circular buffer storing a set of duration data elements.

20. A method as described in claim 13, wherein:

a. during a first time segment each signal transmission event is spaced in time from a previous signal transmission event by a certain time interval characterized by a first duration; and b. during a second time segment each signal transmission event is spaced in time from a previous signal transmission event by a certain time interval characterized by a second duration different from the first duration, at least one of the first duration and second duration being conditioned at least in part on the basis of the selected command.

21. A portable remote control unit implementing the method described in claim 13.

22. A computer readable storage medium including a program element suitable for execution by a computing apparatus for processing commands used in remotely controlling a locomotive, said computing apparatus comprising:

a. a memory;

b. a processor operatively connected to said memory unit, said program element when executing on said processor being operative for:

i. enabling an operator to select a command among a set of available commands;

ii. causing a signal indicative of the selected command to be transmitted repetitively to a receiver onboard the locomotive to create a succession of signal transmission events, each signal transmission event being spaced in time from a previous signal transmission event by a certain time interval characterized by a duration, the duration of the certain time interval being conditioned at least in part on the basis of the selected command.

23. A computer readable storage medium as described in claim 22, wherein said program element when executing on said processor being operative for:

a. deriving a duration data element on the basis of the selected command;

b. varying said time interval on the basis of the duration data element to alter a rate of occurrence of the transmission events on the basis of the selected command.

24. A computer readable storage medium as described in claim 23, wherein commands in the set of available commands arc associated to respective levels of importance, the duration data elements being conditioned at least in part on the basis of the level of importance of selected command.

25. A computer readable storage medium as described in claim 24, wherein a first command is associated to a first level of importance and a second command being associated to a second level of importance, said second level of importance being indicative of a greater importance than said first level of importance, said program element when executing on said processor being operative for associating a first duration data element to said first command and a second duration data element to said second command, the second duration data element being indicative of a shorter duration than the first duration data element.

26. A computer readable storage medium as described in claim 24, wherein said program element when executing on said processor being operative for:

a. providing a data structure associating a command to a corresponding duration data element;

b. processing the selected command to extract from said data structure a certain duration data element corresponding to the selected command;

c. varying said time interval on the basis of the duration data element to alter a rate of occurrence of the transmission events on the basis of the selected command.

27. A computer readable storage medium as described in claim 23, wherein said program element when executing on said processor being operative for:

a. providing a data structure including a plurality of entries, each entry associating one or more commands to a set of corresponding duration data elements;

b. processing the selected command to:

i. locate a certain entry associating the selected command and to a certain set of corresponding duration data elements;

ii. select at least one duration data element from the certain set of corresponding duration data elements;

c. varying said time interval on the basis of the duration data element to alter a rate of occurrence of the transmission events on the basis of the selected command.

28. A computer readable storage medium as described in claim 27, wherein at least one entry in said data structure includes a circular buffer storing a set of duration data elements.

29. A computer readable storage medium as described in claim 22, wherein:

a. during a first time segment each signal transmission event is spaced in time from a previous signal transmission event by a certain time interval characterized by a first duration; and b. during a second time segment each signal transmission event is spaced in time from a previous signal transmission event by a certain time interval characterized by a second duration different from the first duration, at least one of the first duration and second duration being conditioned at least in part on the basis of the selected command.

30. A portable remote control unit including the computer readable storage medium described in claim 22.

31. A remote control unit for controlling a locomotive by transmitting signals to a remote receiver mounted onboard the locomotive, said remote control unit comprising:

a. an input for receiving a signal indicative of a command selected from a set of available commands;

b. a signal transmitting unit operative to transmit said signal indicative of the selected command repetitively to a receiver to create a succession of signal transmission events, each signal transmission event including a message portion and a header portion, the message portion having a length conditioned at least in part on the basis of the selected command, said signal transmitting unit including an RF modulator adapted for modulating data indicative of the selected command to generate a succession of modulated signals, each modulated signal corresponding to a respective signal transmission event in the succession of signal transmission events.

32. A remote control unit as described in claim 31, wherein said signal transmitting unit is operative to transmit said signal repetitively to create a succession of signal transmission events, wherein for at least one command in the set of available commands:

a. during a first time segment, the message portion of each signal transmission event is of a first length; and b. during a second time segment, the message portion of each signal transmission event is of a second length, the second length being different from the first length.

33. A remote control unit as described in claim 32, wherein at least one of the first length and the second length is conditioned at least in part on the basis of the selected command.

34. A remote control unit as described in claim 31, wherein commands in the set of available commands are associated to respective levels of importance, the length of the message portion of each signal transmission event being conditioned at least in part on the basis of the level of importance of selected command.

35. A remote control unit as described in claim 34, wherein a first command is associated to a first level of importance and a second command being associated to a second level of importance, said second level of importance being indicative of a greater importance than said first level of importance, said signal transmitting unit associated a first message length to said first command and a second message length element to said second command, the second message length being indicative of a longer length than the first message length.

36. A remote control unit as described in claim 31, wherein each signal transmission event is spaced in time from a previous signal transmission event by a certain time interval characterized by a duration, said remote control unit further comprising a time interval duration control module for:

a. generating duration data elements at least in part on the basis of the selected command; and b. supplying the duration data elements to said signal transmitting unit for varying said time interval to alter a rate of occurrence of the transmission events on the basis of the selected command.

37. A remote control unit as described in claim 31, wherein said remote control unit is portable.

38. A remote control unit as described in claim 37, comprising a command interface allowing an operator to select a command among a set of available commands, the command interface being manually operable.

39. A remote control unit as described in claim 37, comprising a command interface allowing an operator to select a command among a set of available commands, the command interface being voice operated.

40. A remote control unit for controlling a locomotive by transmitting signals to a remote receiver mounted onboard the locomotive, said remote control unit comprising:

a. an input for receiving a signal indicative of a command selected from a set of available commands;

b. a signal transmitting unit operative to transmit a signal indicative of the selected command repetitively to create a succession of signal transmission events, each signal transmission event including a message portion and a header portion, said signal transmitting unit including:

i. a message length control module having an input to receive at least one parameter, the at least one parameter being derived from the selected command, said message length control module being operative for deriving at least one message length data element at least in part on the basis of the at least one parameter and for releasing the at least one message length data element at an output;

ii. an output module including an RE modulator adapted to output repeatedly a modulated signal indicative of the selected command to create a succession of modulated signals, each modulated signal corresponding to a respective signal transmission event in the succession of signal transmission events, the message portion of each succession of signal transmission event having a length conditioned on the basis of the at least one message length data element.

41. A method for remotely controlling a locomotive, said method comprising:

a. enabling an operator to select a command among a set of available commands;

b. transmitting a signal indicative of the selected command repetitively to a receiver onboard the locomotive to create a succession of signal transmission events, each signal transmission event including a message portion and a header portion, the message portion having a length conditioned at least in part on the basis of the selected command.

42. A method as described in claim 41, wherein for at least one command in the set of available commands:

a. during a first time segment, the message portion of each signal transmission event is of a first length; and b. during a second time segment, the message portion of each signal transmission event is of a second length, the second length being different from the first length.

43. A method as described in claim 42, wherein at least one of the first length and the second length is conditioned at least in part on the basis of the selected command.

44. A method as described in claim 41, wherein commands in the set of available commands are associated to respective levels of importance, the length of the message portion of each signal transmission event being conditioned at least in part on the basis of the level of importance of selected command.

45. A method as described in claim 41, wherein each signal transmission event is spaced in time from a previous signal transmission event by a certain time interval characterized by a duration, said method comprising:

a. generating duration data elements at least in part on the basis of the selected command; and b. varying said time interval on the basis of the duration data elements to alter a rate of occurrence of the transmission events on the basis of the selected command.

46. A portable remote control unit implementing the method described in claim 41.

47. A computer readable storage medium including a program element suitable for execution by a computing apparatus for processing commands used in remotely controlling a locomotive, said computing apparatus comprising:

a. a memory;

b. a processor operatively connected to said memory unit, said program element when executing on said processor being operative for:

i. enabling an operator to select a command among a set of available commands;

ii. causing a signal indicative of the selected command to be transmitted repetitively to a receiver onboard the locomotive to create a succession of signal transmission events, each signal transmission event including a message portion and a header portion, the message portion having a length conditioned at least in part on the basis of the selected command.

48. A computer readable storage medium as described in claim 47, wherein for at least one command in the set of available commands:

a. during a first time segment, the message portion of each signal transmission event is of a first length; and b. during a second time segment, the message portion of each signal transmission event is of a second length, the second length being different from the first length.

49. A computer readable storage medium as described in claim 48, wherein at least one of the first length and the second length is conditioned at least in part on the basis of the selected command.

50. A computer readable storage medium as described in claim 47, wherein commands in the set of available commands are associated to respective levels of importance, the length of the message portion of each signal transmission event being conditioned at least in part on the basis of the level of importance of selected command.

51. A computer readable storage medium as described in claim 47, wherein each signal transmission event is spaced in time from a previous signal transmission event by a certain time interval characterized by a duration, said program element when executing on said processor being operative for:

a. generating duration data elements at least in part on the basis of the selected command; and b. varying said time interval on the basis of the duration data elements to alter a rate of occurrence of the transmission events on the basis of the selected command.

52. A portable remote control unit including the computer readable storage medium described in claim 47.

53. A remote control unit for controlling a locomotive by transmitting signals to a remote receiver mounted onboard the locomotive, said remote control unit comprising:

a. an input for receiving a signal indicative of a command selected from a set of available commands;

b. a signal transmitting unit operative to transmit a signal indicative of the selected command repetitively to create a succession of signal transmission events, the succession of signal transmission events being such that;

i. during a first time segment each signal transmission event is spaced in time from a previous signal transmission event by a certain time interval characterized by a first duration; and ii. during a second time segment each signal transmission event is spaced in time a previous signal transmission event by a certain time interval characterized by a second duration different from the first duration;

iii. wherein at least one of the first duration and second duration is conditioned at least in part on the basis of the selected command;

said signal transmitting unit including an RF modulator adapted for modulating data indicative of the selected command to generate a succession of modulated signals each modulated sianal corresponding to a respective signal transmission event in the succession of signal transmission events.

54. A method for remotely controlling a locomotive comprising:

a. enabling an operator to select a command among a set of available commands;

b. transmitting a signal indicative of the selected command repetitively to a receiver onboard the locomotive to create a succession of sianal transmission events, the succession of sianal transmission events being such that:

i. during a first time segment each sianal transmission event is spaced in time from a previous signal transmission event by a certain time interval characterized by a first duration; and ii. during a second time segment each signal transmission event is spaced in time a previous signal transmission event by a certain time interval characterized by a second duration different from the first duration;

iii. wherein at least one of the first duration and the second duration is conditioned at least in part on the basis of the selected command.

55. A computer readable storage medium including a program element suitable for execution by a computing apparatus for processing commands used in remotely controlling a locomotive, said computing apparatus comprising:

a. a memory;

b. a processor operatively connected to said memory unit, said program element when executing on said processor being operative for:

i. receiving a command selected from a set of available commands;

ii. causing a signal indicative of the selected command to be transmitted repetitively to a receiver onboard the locomotive to create a succession of signal transmission events, the succession of signal transmission events being such that:

1. during a first time segment each signal transmission event is spaced in time from a previous signal transmission event by a certain time interval characterized by a first duration; and 2. during a second time segment each signal transmission event is spaced in time a previous signal transmission event by a certain time interval characterized by a second duration different from the first duration;

3. wherein at least one of the first duration and the second duration is conditioned at least in part on the basis of the selected command.

56. A remote control unit for controlling a locomotive by transmitting signals to a remote receiver mounted onboard the locomotive, said remote control unit comprising:

a. an input for receiving a signal indicative of a command selected from a set of available commands;

b. a signal transmitting unit operative to transmit a signal indicative of the selected command repetitively to create a succession of signal transmission events, each signal transmission event including a message portion and a header portion, wherein for at least one command in the set of available commands:

i. during a first time segment, the message portion of each signal transmission event is of a first length; and ii. during a second time segment, the message portion of each signal transmission event is of a second length, the second length being different from the first length;

said signal transmitting unit including an RF modulator adapted for modulating data indicative of the selected command to generate a succession of modulated signals, each modulated signal corresponding to a respective signal transmission event in the succession of signal transmission events.

57. A remote control unit as described in claim 56, wherein at least one of the first length and the second length is conditioned at least in part on the basis of the selected command.

58. A method for remotely controlling a locomotive comprising:

a. enabling an operator to select a command among a set of available commands;

b. transmitting a signal indicative of the selected command repetitively to a receiver onboard the locomotive to create a succession of signal transmission events, each signal transmission event including a message portion and a header portion, wherein for at least one command in the set of available commands:

i. during a first time segment, the message portion of each signal transmission event is of a first length; and ii. during a second time segment, the message portion of each signal transmission event is of a second length, the second length being different from the first length.

59. A method as described in claim 58, wherein at least one of the first length and the second length is conditioned at least in part on the basis of the selected command.

60. A computer readable storage medium including a program element suitable for execution by a computing apparatus for processing commands used in remotely controlling a locomotive, said computing apparatus comprising:

a. a memory;

b. a processor operatively connected to said memory unit, said program element when executing on said processor being operative for:

i. enabling an operator to select a command among a set of available commands;

ii. causing a signal indicative of the selected command to be transmitted repetitively to a receiver onboard the locomotive to create a succession of signal transmission events, each signal transmission event including a message portion and a header portion, wherein for at least one command in the set of available commands:

1. during a first time segment, the message portion of each signal transmission event is of a first length; and 2. during a second time segment, the message portion of each signal transmission event is of a second length, the second length being different from the first length.

61. A computer readable storage medium as described in claim 60, wherein at least one of the first length and the second length is conditioned at least in part on the basis of the selected command.

62. A remote control unit for controlling a locomotive by transmitting signals to a remote receiver mounted onboard the locomotive, said remote control unit comprising:

a. means for allowing an operator to select a command among a set of available commands;

b. means operative to transmit a signal indicative of the selected command repetitively to create a succession of signal transmission events, each signal transmission event being spaced in time from a previous signal transmission event by a certain time interval characterized by a duration, the duration of the certain time interval being conditioned at least in part on the basis of the selected command.

63. A remote control unit for controlling a locomotive by transmitting signals to a remote receiver mounted onboard the locomotive, said remote control unit comprising:

a. means for allowing an operator to select a command among a set of available commands;

b. means operative to transmit said signal indicative of the selected command repetitively to a receiver to create a succession of signal transmission events, each signal transmission event including a message portion and a header portion, the message portion having a length conditioned at least in part on the basis of the selected command.

64. A remote control unit for controlling a locomotive by transmitting signals to a remote receiver mounted onboard the locomotive, said remote control unit comprising:

a. means for allowing an operator to select a command among a set of available commands;

b. means operative to transmit a signal indicative of the selected command repetitively to create a succession of signal transmission events, the succession of signal transmission events being such that:

i. during a first time segment each signal transmission event is spaced in time from a previous signal transmission event by a certain time interval characterized by a first duration; and ii. during a second time segment each signal transmission event is spaced in time a previous signal transmission event by a certain time interval characterized by a second duration different from the first duration;

iii. wherein at least one of the first duration and second duration is conditioned at least in part on the basis of the selected command.

65. A remote control unit for controlling a locomotive by transmitting signals to a remote receiver mounted onboard the locomotive, said remote control unit comprising:

a. means for allowing an operator to select a command among a set of available commands;

b. means operative to transmit a signal indicative of the selected command repetitively to create a succession of signal transmission events, each signal transmission event including a message portion and a header portion, wherein for at least one command in the set of available commands:

i. during a first time segment, the message portion of each signal transmission event is of a first length; and ii. during a second time segment, the message portion of each signal transmission event is of a second length, the second length being different from the first length.

66. A remote control unit for controlling a vehicle by transmitting signals to a remote receiver mounted on the vehicle, said remote control unit comprising:

a. a command interface allowing an operator to select a command among a set of available commands;

b. a signal transmitting unit operative to transmit a signal indicative of the selected command repetitively to create a succession of signal transmission events, each signal transmission event being spaced in time from a previous signal transmission event by a certain time interval characterized by a duration, the duration of the certain time interval being conditioned at least in part on the basis of the selected command, said signal transmitting unit including an RE modulator adapted for modulating data indicative of the selected command to generate a succession of modulated signals, each modulated signal corresponding to a respective signal transmission event in the succession of signal transmission events.

67. A method for remotely controlling a locomotive, said method comprising:

a. enabling an operator to select a command among a set of available commands;

b. transmitting a signal indicative of the selected command repetitively to a receiver onboard the locomotive to create a succession of signal transmission events, each signal transmission event having a signal power level, the signal power level being conditioned at least in part on the basis of the selected command.

68. A method as described in claim 67, said method further comprising:

a. deriving a power level data element at least in part on the basis of the selected command; and b. varying the power level of the transmission events on the basis of the power level data element.

69. A method as described in claim 68, wherein commands in the set of available commands are associated to respective levels of importance, the power level data elements being conditioned at least in part on the basis of the level of importance of selected command.

70. A method as described in claim 69, wherein a first command is associated to a first level of importance and a second command being associated to a second level of importance, said second level of importance being indicative of a greater importance than said first level of importance, said method including associating a first power level data element to said first command and a second power level data element to said second command, the second power level data element being indicative of a greater power level than the first power level data element.

71. A method as described in claim 67, wherein:

a. during a first time segment each signal transmission event is transmitted at a first power level; and b. during a second time segment each signal transmission event is transmitted at a second power level different from the first power level, at least one of the first power level and second power level being conditioned at least in part on the basis of the selected command.

72. A portable remote control unit implementing the method described in claim 67.

73. A remote control unit for controlling a locomotive by transmitting signals to a remote receiver mounted onboard the locomotive, said remote control unit comprising:

a. an input for receiving a signal indicative of a command selected from a set of available commands;

b. a signal transmitting unit operative to transmit a signal indicative of the selected command repetitively to create a succession of signal transmission events, each signal transmission event having a signal power level, the signal power level being conditioned at least in part on the basis of the selected command, said signal transmitting unit including an RF modulator adapted for modulating data indicative of the selected command to generate a succession of modulated signals, each modulated signal corresponding to a respective signal transmission event in the succession of signal transmission events.

74. A remote control unit as described in claim 73, said remote control unit further comprising a power level control module for:

a. deriving a power level data element at least in part on the basis of the selected command; and b. supplying the power level data element to said signal transmitting unit for varying said power level on the basis of the selected command.

75. A remote control unit as described in claim 74, wherein commands in the set of available commands are associated to respective levels of importance, the power level data elements being conditioned at least in part on the basis of the level of importance of selected command.

76. A remote control unit as described in claim 75, wherein a first command is associated to a first level of importance and a second command being associated to a second level of importance, said second level of importance being indicative of a greater importance than said first level of importance, said power level control module being adapted to associate a first power level data element to said first command and a second power level data element to said second command, the second power level data element being indicative of a greater power level than the first power level data element.

77. A remote control unit as described in claim 75, said first power level control module includes:

a. a data structure associating a command to a corresponding power level data element;

b. a processing unit adapted for processing the selected command to extract from said data structure a certain power level data element corresponding to the selected command;

c. an output for providing the certain power level data element to said signal transmitting unit for varying said power level to alter the power level of the transmission events on the basis of the selected command.

78. A remote control unit as described in claim 75, said power level control module includes:

a. a data structure including a plurality of entries, each entry associating one or more commands to a set of corresponding power level data elements;

b. a processing unit adapted for processing the selected command to:

i. locate a certain entry associating the selected command and to a certain set of corresponding power level data elements;

ii. select at least one power level data element from the certain set of corresponding power level data elements;

c. an output for providing the at least one power level data elements to said signal transmitting unit for varying said power level to alter a power level of the transmission events on the basis of the selected command.

79. A remote control unit as described in claim 74, wherein said signal transmitting unit is operative to transmit said signal repetitively to create a succession of signal transmission events, wherein:

a. during a first time segment each signal transmission event has a first power level; and b. during a second time segment each signal transmission event has a second power level different from the first power level, at least one of the first power level and second power level being conditioned at least in part on the basis of the selected command.

80. A computer readable storage medium including a program element suitable for execution by a computing apparatus for processing commands used in remotely controlling a locomotive, said computing apparatus comprising:

a. a memory;

b. a processor operatively connected to said memory unit, said program element when executing on said processor being operative for:

i. enabling an operator to select a command among a set of available commands;

ii. causing a signal indicative of the selected command to be transmitted repetitively to a receiver onboard the locomotive to create a succession of signal transmission events, each signal transmission event having a signal power level, the signal power level being conditioned at least in part on the basis of the selected command.

81. A computer readable storage medium as described in claim 80, wherein said program element when executing on said processor being operative for:

a. deriving a power level data element on the basis of the selected command;

b. varying said signal power level on the basis of the power level data element for varying said power level on the basis of the selected command.

82. A computer readable storage medium as described in claim 80, wherein commands in the set of available commands are associated to respective levels of importance, the power level data elements being conditioned at least in part on the basis of the level of importance of selected command.

83. A computer readable storage medium as described in claim 82, wherein a first command is associated to a first level of importance and a second command being associated to a second level of importance, said second level of importance being indicative of a greater importance than said first level of importance, said program element when executing on said processor being operative for associating a first power level data element to said first command and a second power level data element to said second command, the second power level data element being indicative of a greater power level than the first power level data element.

84. A computer readable storage medium as described in claim 80, wherein said program element when executing on said processor being operative for:

a. providing a data structure associating a command to a corresponding power level data element;

b. processing the selected command to extract from said data structure a certain power level data element corresponding to the selected command;

c. varying the power level of the transmission events on the basis of the power level data element.

85. A computer readable storage medium as described in claim 80, wherein said program element when executing on said processor being operative for:

a. providing a data structure including a plurality of entries, each entry associating one or more commands to a set of corresponding power level data elements;

b. processing the selected command to:

i. locate a certain entry associating the selected command and to a certain set of corresponding power level data elements;

ii. select at least one power level data element from the certain set of corresponding power level data elements;

c. varying the power level of the transmission events on the basis of the power level data element.

86. A computer readable storage medium as described in claim 80, wherein:

a. during a first time segment each signal transmission event has a first power level; and b. during a second time segment each signal transmission event has a second power level different from the first power level, at least one of the first power level and second power level being conditioned at least in part on the basis of the selected command.

87. A remote control unit for controlling a locomotive by transmitting signals to a remote receiver mounted onboard the locomotive, said remote control unit comprising:

a. an input for receiving a signal indicative of a command selected from a set of available commands;

b. a signal transmitting unit operative to transmit a signal indicative of the selected command repetitively to create a succession of signal transmission events, wherein for at least one command in the set of available commands:

i. during a first time segment, the signal transmission events are transmitted at a first power level; and ii. during a second time segment, the signal transmission events are transmitted at a second power level, the second power level being different from the first power level;

said signal transmitting unit including an RF modulator adapted for modulating data indicative of the selected command to generate a succession of modulated signals, each modulated signal corresponding to a respective signal transmission event in the succession of signal transmission events.

* * * * *